US007142078B2

(12) United States Patent
Rostaing et al.

(10) Patent No.: US 7,142,078 B2
(45) Date of Patent: Nov. 28, 2006

(54) MAGNETIC LEVITATION ACTUATOR

(75) Inventors: Herve Rostaing, Meylan (FR); Jerome Delamare, Grenoble (FR); Orphee Cugat, Poisat (FR); Christel Locatelli, Crolles (FR)

(73) Assignees: Commissariat a l'Energie Atomique, Paris (FR); Centre National de la Recherche Scientifique, Paris (FR); Institut National Polytechnique de Grenoble, Grenoble (FR)

( * ) Notice: Subject to any disclaimer, the term of this patent is extended or adjusted under 35 U.S.C. 154(b) by 0 days.

(21) Appl. No.: 10/522,626

(22) PCT Filed: Jul. 30, 2003

(86) PCT No.: PCT/FR03/02410

§ 371 (c)(1),
(2), (4) Date: Jan. 31, 2005

(87) PCT Pub. No.: WO2004/015725

PCT Pub. Date: Feb. 19, 2004

(65) Prior Publication Data

US 2005/0237140 A1 Oct. 27, 2005

(30) Foreign Application Priority Data

Aug. 2, 2002 (FR) ..... 02 09882

(51) Int. Cl.
*H01F 7/08* (2006.01)

(52) U.S. Cl. ..... 335/234; 239/571

(58) Field of Classification Search ..... 335/229, 335/234, 236; 251/129.17

See application file for complete search history.

(56) References Cited

U.S. PATENT DOCUMENTS 3,634,735 A * 1/1972 Komatsu ..... 361/194
4,533,890 A * 8/1985 Patel ..... 335/234

(Continued)

FOREIGN PATENT DOCUMENTS

DE 202 03 718 7/2002

(Continued)

OTHER PUBLICATIONS

Ye X Y et al: "A magnetic levitation actuator for micro-assembly" Tranducers 97. 1997 International Conference on Solid-State Sensors and Actuators. Digest of Technical Papers (Cat. No. 97th8267), Proceedings of International Solid State Sensors and Actuators Conference, vol. 2, pp. 797-799, Jun. 16-19, 1997.

(Continued)

*Primary Examiner*—Elvin Enad
*Assistant Examiner*—Bernard Rojas
(74) *Attorney, Agent, or Firm*—Oblon, Spivak, McClelland, Maier & Neustadt, P.C.

(57) ABSTRACT

A magnetic actuator including a mobile magnetic part, a fixed magnetic part, and a mechanism for triggering displacement of the mobile magnetic part relatively to the fixed magnetic part. At least two amagnetic supports, placed in different planes, delimit a gap between them, the fixed magnetic part being integral with at least one of the supports. The supports each have an abutment area for the mobile magnetic part, the abutment area being distinct from the fixed magnetic part. The mobile magnetic part is in levitation in the gap between both supports by magnetic guiding due to the fixed magnetic part when it does not abut against the abutment area of one of the supports. The mobile magnetic part can assume plural stable magnetic positions; in each of these positions, it abuts against a support.

23 Claims, 18 Drawing Sheets

U.S. PATENT DOCUMENTS

| | | | | |
|---|---|---|---|---|
| 4,536,230 | A * | 8/1985 | Landa et al. | 148/301 |
| 4,763,843 | A * | 8/1988 | Bombis et al. | 239/571 |
| 4,883,025 | A * | 11/1989 | Richeson, Jr. | 123/90.11 |
| 4,928,028 | A * | 5/1990 | Leibovich | 310/23 |
| 5,144,982 | A * | 9/1992 | Willbanks | 137/625.5 |
| 5,883,557 | A * | 3/1999 | Pawlak et al. | 335/179 |
| 6,180,928 | B1 * | 1/2001 | Garrigus | 219/491 |
| 6,842,226 | B1 * | 1/2005 | Watson et al. | 355/72 |

FOREIGN PATENT DOCUMENTS

| | | |
|---|---|---|
| EP | 0 193 664 | 9/1986 |

OTHER PUBLICATIONS

Ruan M et al: "Latching Micromagnetic Relays" Journal of Microelectromechanical Systems, vol. 10, No. 4, pp. 511-517, Dec. 2001.

* cited by examiner

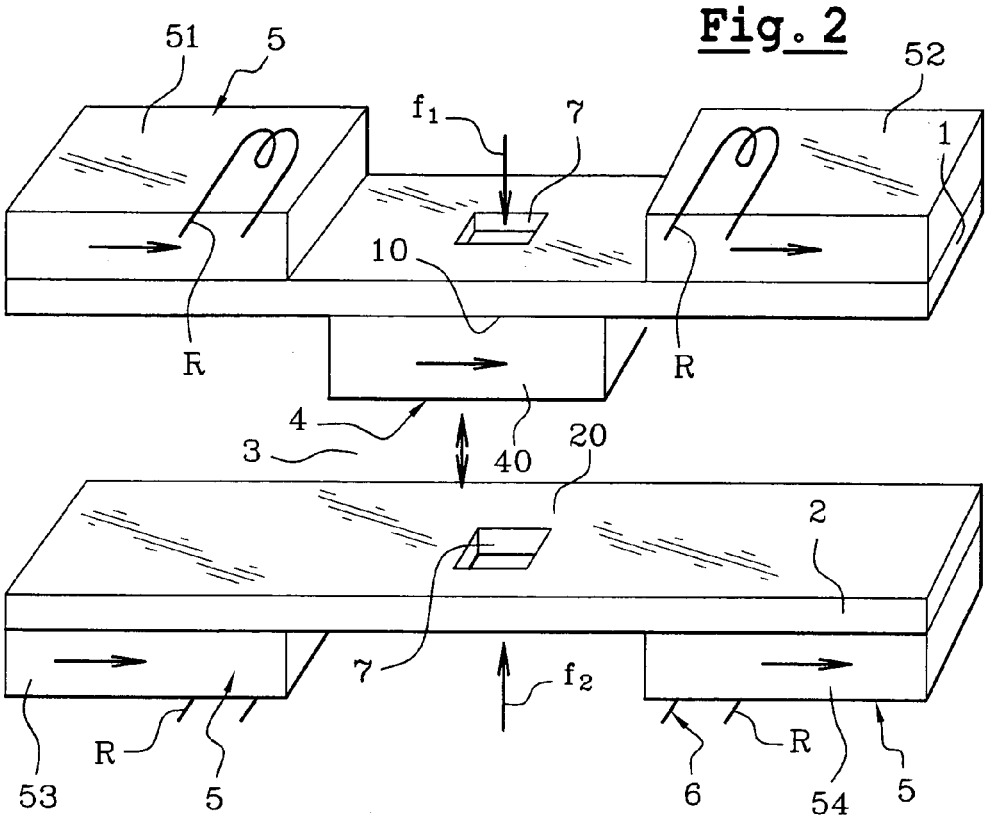
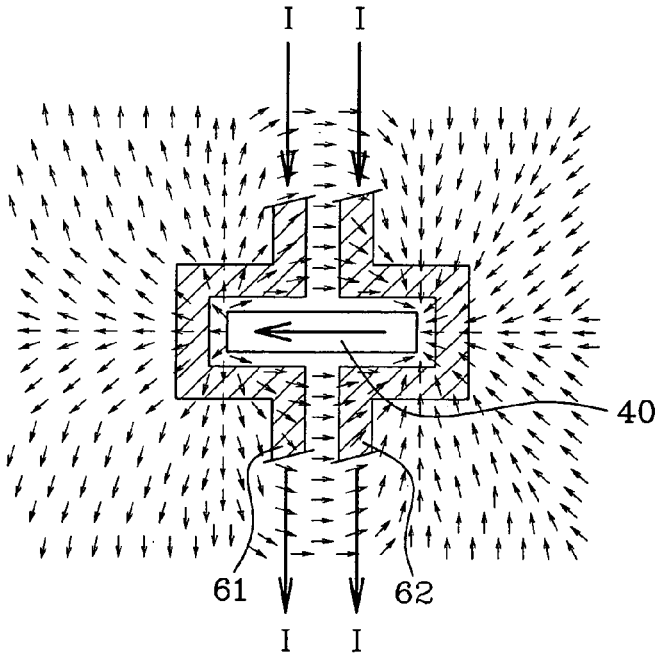
Fig. 3

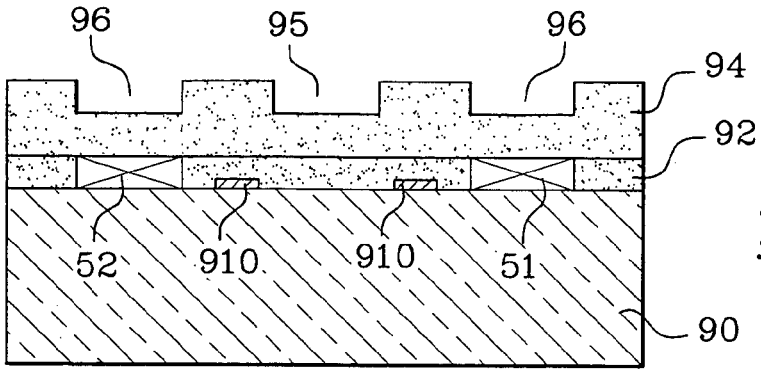
Fig. 10G1
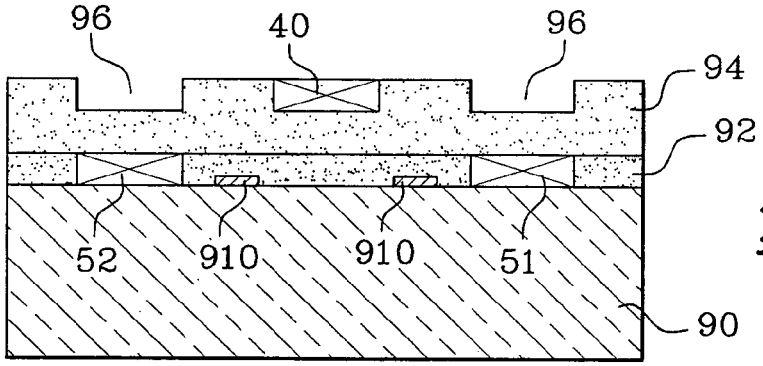
Fig. 10H1
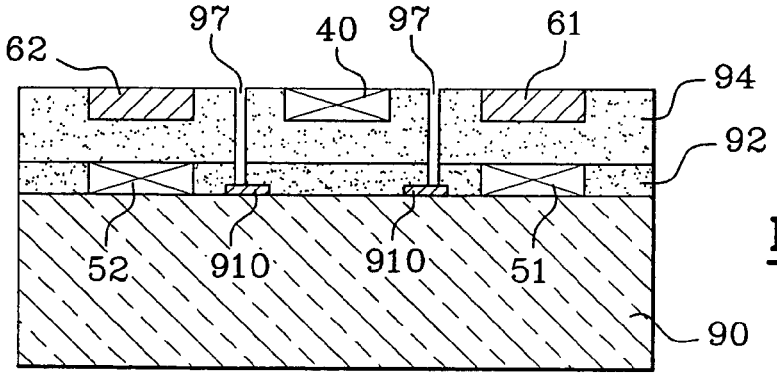
Fig. 10I1

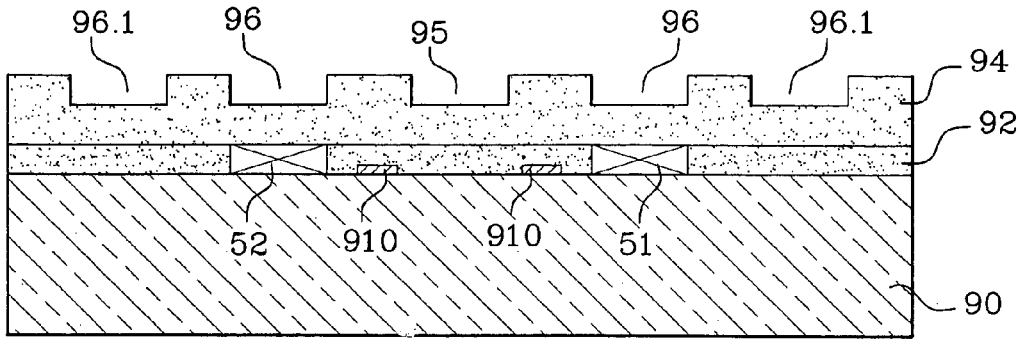
Fig. 10G2
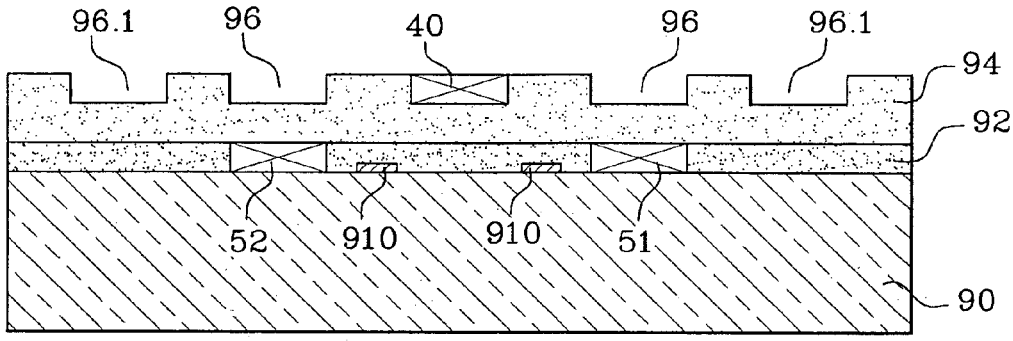
Fig. 10H2
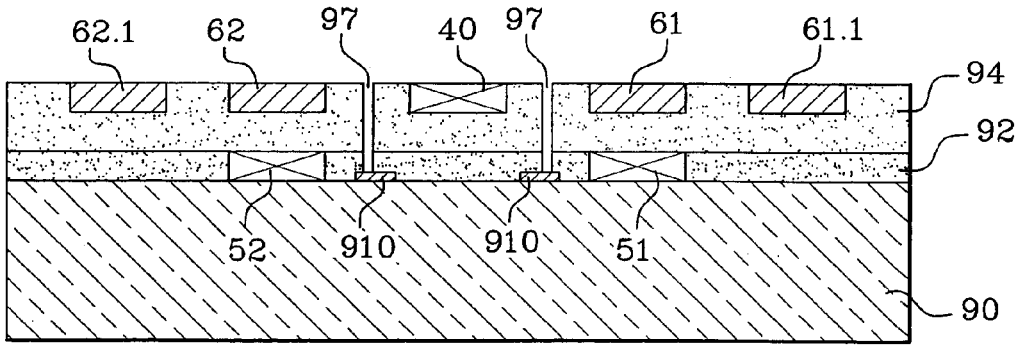
Fig. 10I2

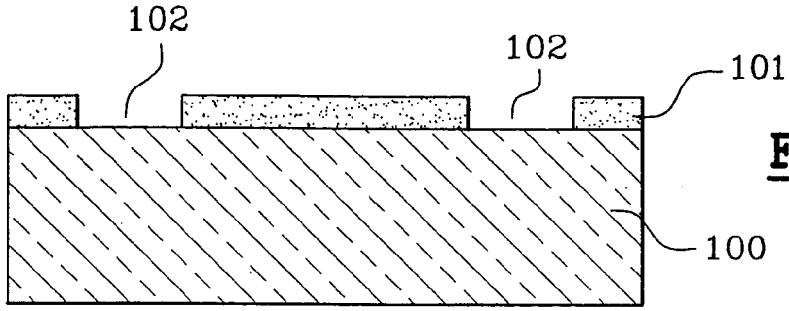
Fig. 11A
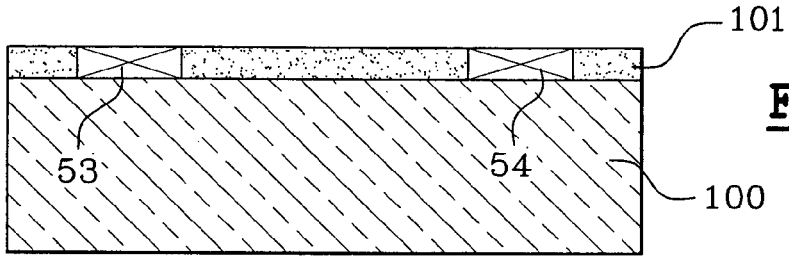
Fig. 11B
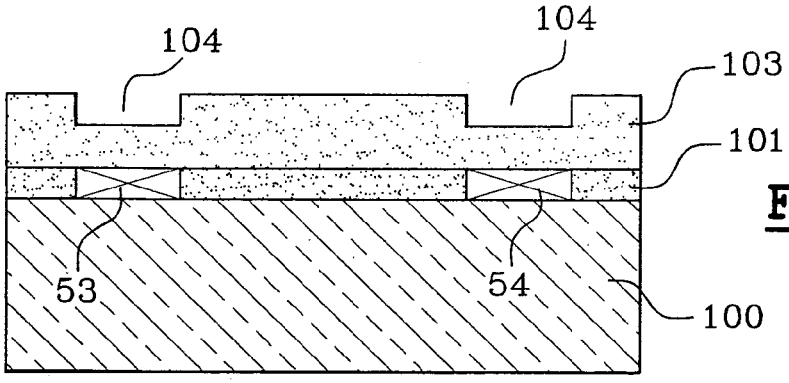
Fig. 11C1
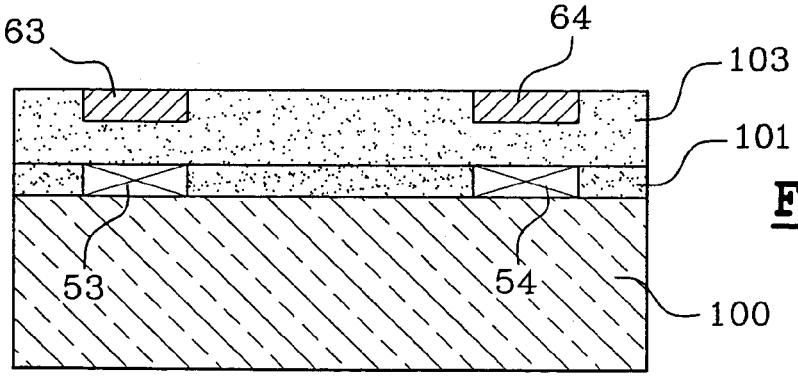
Fig. 11D1

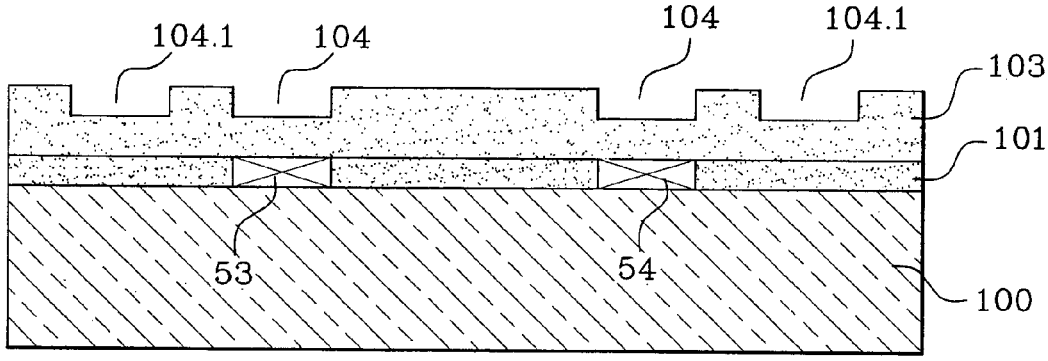
Fig. 11C2
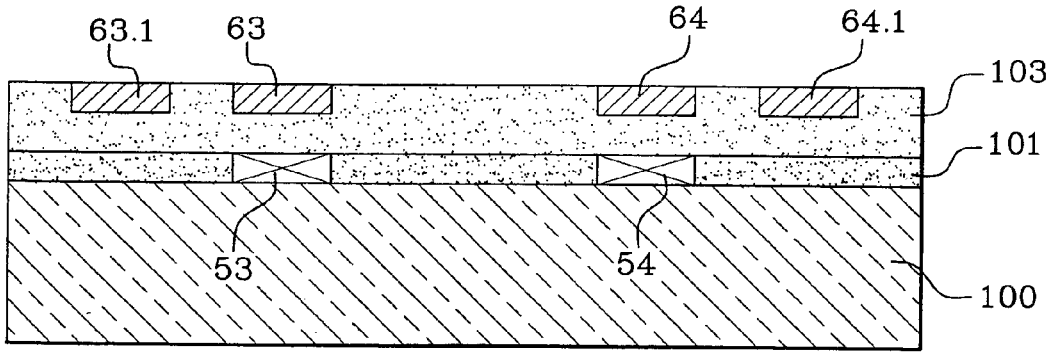
Fig. 11D2

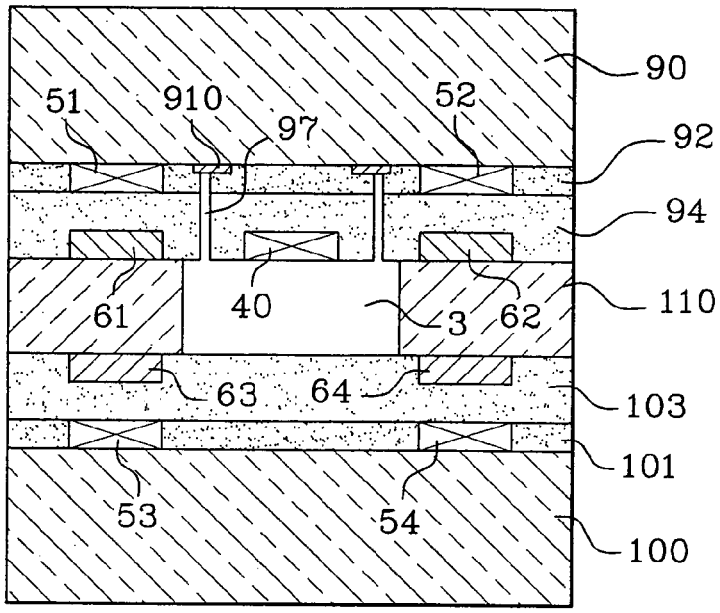
Fig. 12A1
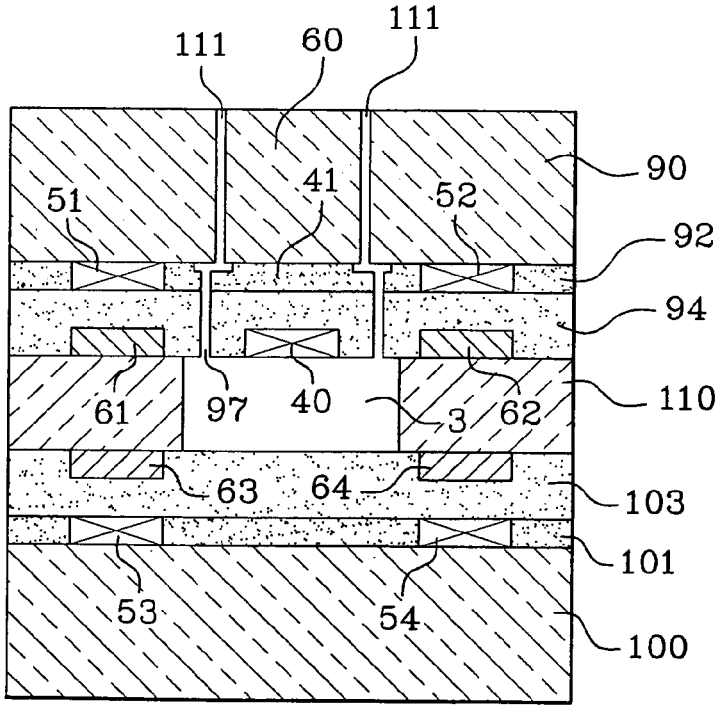
Fig. 12B1

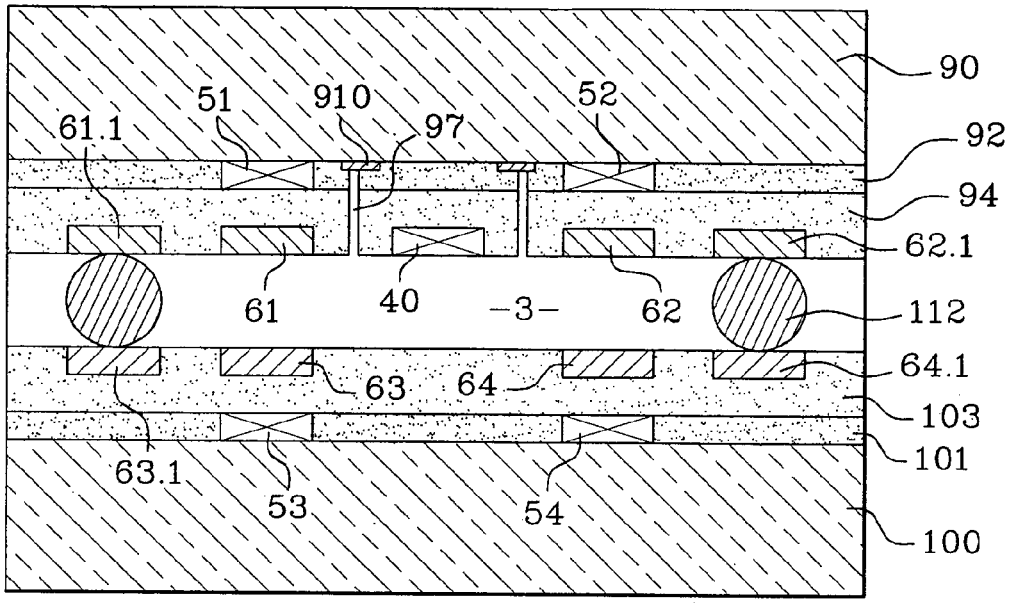
Fig. 12A2
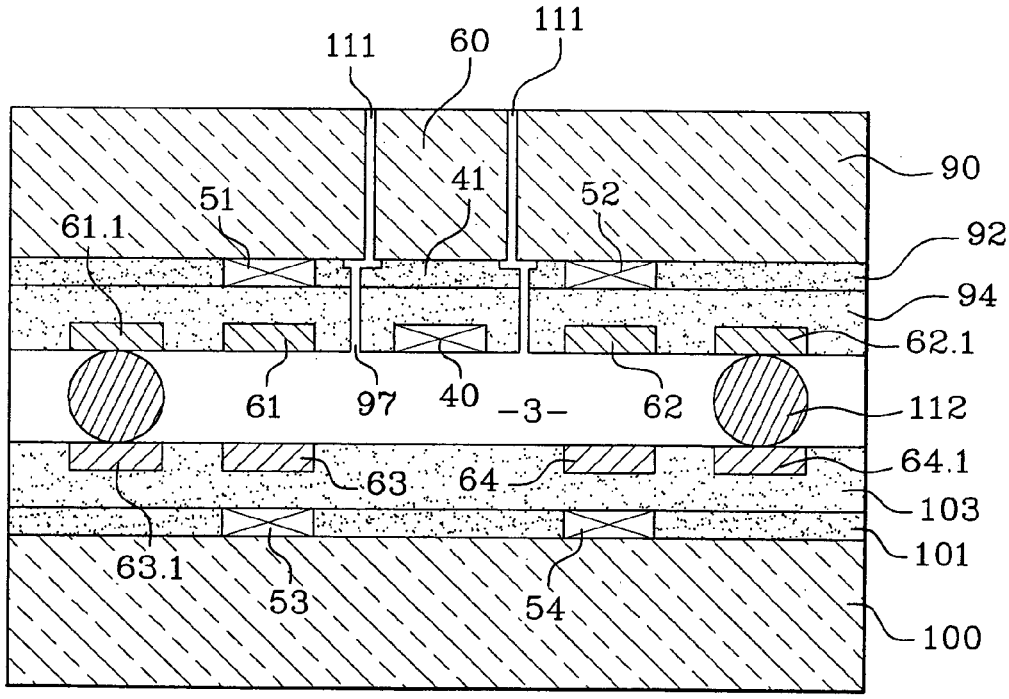
Fig. 12B2

MAGNETIC LEVITATION ACTUATOR

TECHNICAL FIELD

The object of the present invention is a magnetic actuator and notably a magnetic micro-actuator which may be made by means of microtechnological techniques, i.e., micromachining techniques used in microelectronics.

Such an actuator may be used in various systems, for example as an electrical micro-relay for controlling the opening, the closing, or switching of an electrical contact, for example for controlling transistors, as an optical micro-relay for controlling the passage, the blanking out, the switching or branching of a light ray, as a microvalve or microgate for controlling the passage, the stopping or the branching of a fluid, as an impact or displacement sensor, as a micropump, as a positioner for magnetic or optical heads, for carrying out AFM (Atomic Force Microscope) or thermal recordings, in positioning tables.

STATE OF THE PRIOR ART

Presently, actuators made by using microtechnological techniques, are essentially thermal or electrostatic actuators. Presently, electrostatic actuators are the most studied actuators. Lucent markets an optical multiplexer known under the designation of "lambda router", including electrostatic actuators. It is capable of directing a light beam from an optical fiber towards another optical fiber selected from a group of optical fibers. Its principle is based on the displacement of micromirrors pivotally linked with a substrate. This multiplexer has a relatively slow switching time. Moreover, such actuators pose a significant problem as regards their electric power supply. Indeed, they need to be supplied with voltages of several tens or even hundreds of volts. So they need to be associated with a specific power supply which poses problem in standalone applications. Another drawback is that the displacements remain limited with respect to the size of the object.

Although the manufacturing technique is more complicated, there exist a few magnetic actuators as well. They operate on the electromagnet principle and essentially use iron-based magnetic circuits and an energizing coil. They include a fixed magnetic part and a mobile magnetic part which is mechanically connected to the fixed magnetic part. The mobile magnetic part may be energized by an electrical circuit in order to cause it to assume a working position by causing it to move relatively to the fixed magnetic part. In the absence of energization, the mobile magnetic part is in an idle position.

A magnetic micro-actuator with a magnet made on a silicon substrate is known from the article "Latching micromagnetic relays with multistrip permalloy cantilevers" of M. Ruan and J. Shen, published in IEEE MEMS 2001, pages 224–227. The magnet is fixed, it is embedded into the silicon and covered with a control coil. The mobile magnetic part is beam-shaped with a pivot linkage in its center allowing a swinging movement relatively to the fixed magnetic part.

Another type of magnetic micro-actuator with a magnet was described on the Internet web site of the IBM Research Laboratory in Zurich (www.zurich.ibm.com) under the title "Electromagnetic scanner" in April 2001. The micro-actuator operates on the principle of a loudspeaker. Planar coils placed on a substrate control the displacement of magnets integral with a base plate, the latter being mechanically suspended by flexible beams to a fixed frame integral with the substrate.

In all these actuators, the mobile magnetic part is mechanically connected to the fixed magnetic part. This mechanical connection is tricky to make with collective manufacturing techniques. Moreover, this connection limits the mobility of the mobile magnetic part, this mobility results from deformation of one of the components connecting the mobile component part to the fixed component part. This deformation during displacements may induce fatigue of the component connecting the mobile magnetic component part to the fixed magnetic component part. Speed performances of such magnetic actuators are low.

The forces driving the mobile magnetic part are due to the magnetic field created by at least one coil. Now, at a constant current density, a microcoil creates a much weaker force than a coil of the same shape but of larger dimensions. The performances of such actuators therefore remain poor. The mass forces which they are able to provide are weak, comparatively to their size.

Moreover, such actuators need to be electrically powered when they are in a working position. In the absence of any power supply, they return to their idle position. Their electrical power consumption is not insignificant.

DISCUSSION OF THE INVENTION

The very object of the present invention is to propose a magnetic actuator which does not have the aforementioned drawbacks.

This actuator utilizes the principle of magnetically guiding a mobile magnetic part, i.e., displacing it without any mechanical contact other than that of the ambient air, when it is used in air.

The magnetic actuator of the present invention is particularly adapted to being made with microtechnology.

More specifically, the present invention is a magnetic actuator including a mobile magnetic part, a fixed magnetic part and means for triggering the displacement of the mobile magnetic part relatively to the fixed magnetic part. It includes at least two amagnetic supports placed in different planes, delimiting a gap between them, the fixed magnetic part being integral with at least one of the supports, the supports each having a abutment area for the mobile magnetic part, the abutment area and the fixed magnetic part being distinct. The mobile magnetic part is in levitation in the gap between both supports by means of a magnetic guide, due to the fixed magnetic part when it is not abutted against the abutment area of one of the supports, the mobile magnetic part is able to assume several stable magnetic positions and in these positions, it is abutted against a support.

By stable magnetic position, a stable position is meant in which there is magnetic interaction between the mobile magnetic part and the fixed magnetic part and which does not require any electric power supply for maintaining this position.

Hence, during its displacement, the mobile magnetic part is not mechanically connected to the fixed magnetic part, and there is no mechanical guide between the mobile magnetic part and the fixed magnetic part.

Simply and advantageously, the mobile magnetic part includes a magnet.

The fixed magnetic part may include at least one magnetic component part.

The magnetic component part may be a magnet. It may be thermomagnetic.

The fixed magnetic part may include at least a pair of magnetic component parts on a support.

Interaction between the fixed magnetic part and the mobile magnetic part achieves centering of the mobile magnetic part on the abutment area, but this centering may be reinforced. For this, the mobile magnetic part and at least one of the supports may include means for mechanically centering the mobile magnetic part on the abutment area of said support.

The magnetic centering means may be substantially bevelled or chamfered relief features both borne by the support and the mobile magnetic part, these relief features having conjugate shapes.

The fixed magnetic part contributes to delimit at least one of the abutment areas.

The means for triggering displacement of the mobile magnetic part may be borne by at least one of the supports. They may have a magnetic effect.

The means for triggering the displacement of the mobile magnetic part may heat the fixed magnetic part and change its magnetic properties.

In one alternative, the means for triggering the displacement of the mobile magnetic part may create a magnetic field in the vicinity of the mobile magnetic part. In this case, they may be embodied by at least one conductor able to have an electric current flow through it. Power consumption is zero when the mobile magnetic part abuts against one of the amagnetic supports, i.e., in the working position.

It is possible to provide means for controlling the current to be caused to flow in the conductor, by the position of the mobile magnetic part so that it may assume a plurality of stable positions in levitation. The magnetic actuator may then be used as a positioner.

According to another embodiment, the means for triggering the displacement of the mobile magnetic part may be pneumatic or hydraulic means.

The fixed magnetic part may be made in a material selected from the group of soft magnetic materials, hard magnetic materials, materials with hysteresis, superconducting materials, diamagnetic materials, these materials being taken alone or combined.

The supports may be made on the basis of semiconducting material, dielectric material or conducting material, these materials being taken alone or combined.

From the manufacturing point of view, it is particularly advantageous that the magnetization of the fixed magnetic part and that of the mobile magnetic part are pointing in a same direction.

In order that the magnetic actuator may operate as an electrical relay, at least one abutment area includes a pair of electrical contacts and the mobile magnetic part includes at least one electrical contact, the mobile magnetic part moving to connect both electrical contacts of the pair of electrical contacts, when it abuts against the abutment area.

In order that the magnetic actuator may operate as a valve, at least one of the supports includes in the abutment area, a port through which fluid passes.

In order that the magnetic actuator may operate as an optical relay, the mobile magnetic part includes a mirror to be passed through a slot of one of the supports.

The present invention also relates to a matrix of magnetic actuators, it includes a plurality of thereby characterized magnetic actuators, these magnetic actuators sharing at least a same support.

The present invention also relates to a method for making a magnetic actuator. It includes the following steps:

on a first amagnetic substrate, making a sacrificial frame following the contour of a base of a mobile magnetic part, depositing a first dielectric layer on the first substrate and producing at least one casing able to receive a fixed magnetic part, depositing the fixed magnetic part in the casing, depositing a second dielectric layer on the first dielectric layer and producing casings able to receive the mobile magnetic part and at least one conductor of means for triggering the displacement of the mobile magnetic part, depositing the mobile magnetic part and the conductor in the casings, etching one or more trenches in the dielectric layers, which reach the sacrificial frame, assembling the first substrate turned upside down over a second amagnetic substrate in order to delimit a gap between both substrates, this gap being intended for the displacement of the mobile magnetic part, etching the first substrate and removing the sacrificial frame in order to free the mobile magnetic part and the base.

The method may include a step for inserting at least one spacer between the first and second substrates at the moment of assembly.

In one alternative, the gap may be formed with beads of meltable material, inserted between the first and the second substrate at the moment of the assembly and by annealing said beads after assembly.

The method may include, before assembling both of the substrates, the following steps:

making on the second substrate, in a first dielectric layer, at least one casing able to receive the fixed magnetic part, depositing the fixed magnetic part in the casing, depositing a second dielectric layer on the first dielectric layer, and producing at least one casing able to receive at least one conductor of the means for triggering the displacement of the mobile magnetic part, depositing the conductor in the casing.

The method may provide a step for magnetizing the mobile magnetic part and optionally the fixed magnetic part before the step for releasing the mobile magnetic part.

The first substrate is tapered before the step for etching the first substrate, the etched part having a mirror function.

The first substrate and the second substrate may be made on the basis of semiconducting material or dielectric material.

BRIEF DESCRIPTION OF THE DRAWINGS

The present invention will be better understood upon reading the description of exemplary embodiments given as purely indicative and by no means limiting, with reference to the appended drawings wherein:

FIG. 2 shows a magnetic actuator according to the invention operating as a gate valve;

FIG. 3 shows the magnetic field lines which are established around the magnet of the mobile magnetic part of a magnetic actuator according to the invention, as well as the conductors of the means for triggering the displacement of the mobile magnetic part;

FIGS. 10A–10I1 and 10I2 show an exemplary embodiment of the first support, of the mobile magnetic part, of a pair of magnets and of a pair of conductors of a magnetic actuator according to the invention;

FIGS. 11A–11D1 and 11D2 show an exemplary embodiment of the second support, of a pair of magnets and of a pair of conductors of a magnetic actuator according to the invention;

FIGS. 12A1, 12A2, 12B1, 12B2 show the steps for assembling both supports and for releasing the mobile magnetic part;

Identical, similar or equivalent portions of the different figures described hereafter bear the same numerical references in order to facilitate the passage from one figure to another.

The different parts illustrated in the figures are not necessarily illustrated according to a uniform scale, so as to make the figure more legible.

DETAILED DISCUSSION OF THE PARTICULAR EMBODIMENTS

Figure 1A:
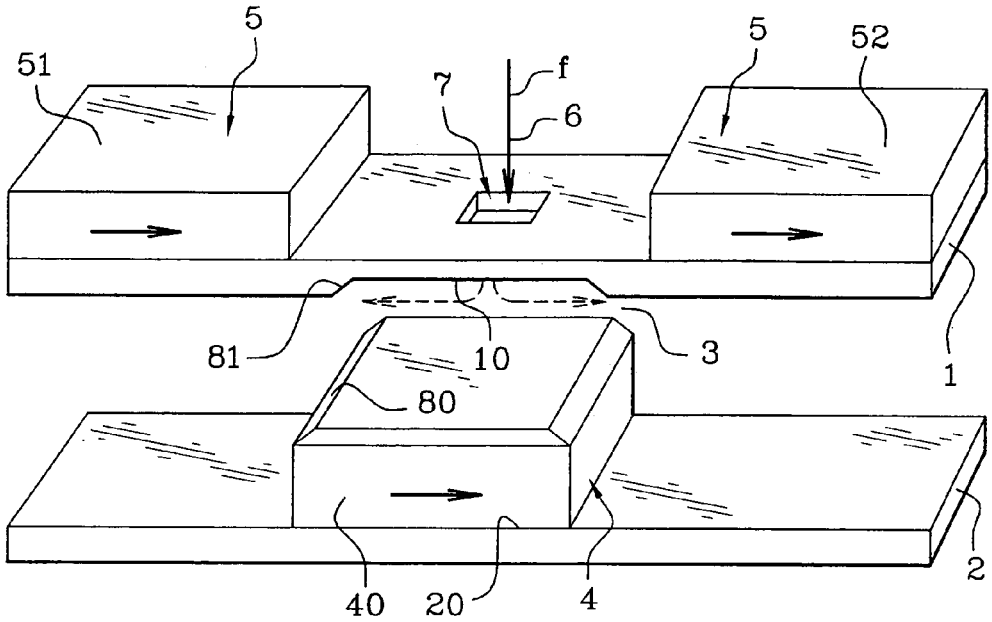
FIGS. 1A, 1B show in two stable positions, a magnetic actuator according to the invention operating as a valve.
Figure 1B:
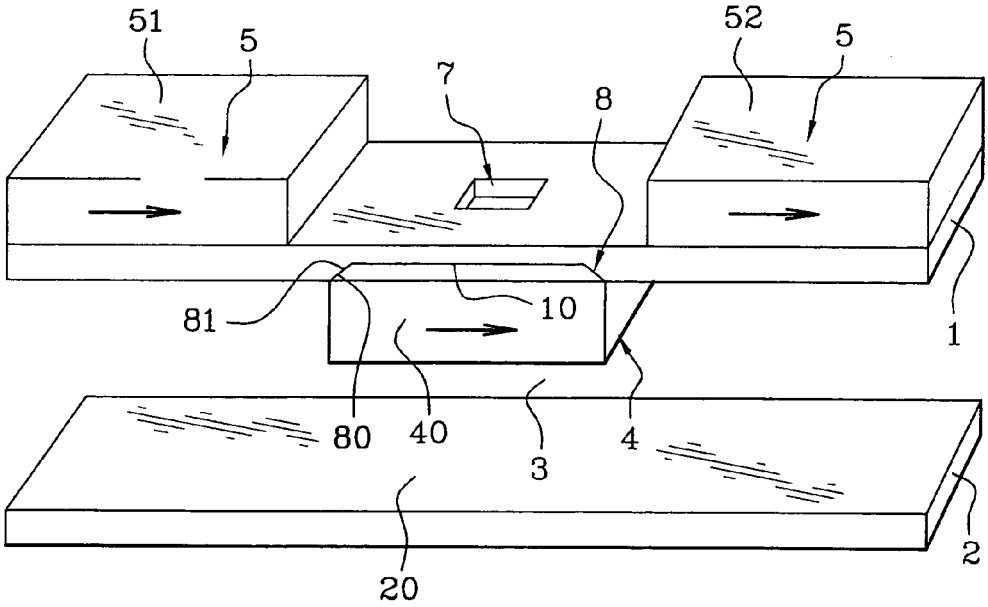

Reference will be made to FIGS. 1A, 1B which schematically show an exemplary magnetic actuator according to the invention in two different stable abutted positions. It is assumed that the actuator is a valve in this embodiment. This actuator includes a first amagnetic support 1 and a second amagnetic support 2, arranged as strata in different planes and delimiting between them a gap 3 wherein a mobile magnetic part 4 is able to move. It may be noted that there is no notion of verticality or horizontality as the mass of the actuator is very low relatively to the magnetic forces at work.

In FIGS. 1A, 1B, the supports are illustrated as plates arranged substantially in parallel, one above the other, the first support 1 being on the top and the second support 2 at the bottom. Another orientation and/or another shape of the supports are possible. Supports 1, 2 may for example, be made on the basis of a semiconducting material, such as silicon or gallium arsenide, a dielectric material such as ceramic, glass, or a plastic material, a conducting material such as aluminium. Combinations of several of these materials may be contemplated. However, supports 1, 2 preferably are electric insulators at least locally, insofar that they bear both magnetic portions and electric conductors.

This actuator also includes a fixed magnetic part 5 integral with at least one of the supports 1, 2. In FIGS. 1A, 1B, the fixed magnetic part 5 is formed with two magnetic component parts 51, 52, which are integral with the first support 1. These magnetic component parts may be magnets but this is not mandatory. It is assumed in the remainder of the description that these are magnets except if indicated otherwise. They are placed on one of its main faces, the one which is found opposite the gap 3. The second support 2 does not bear any fixed magnetic part.

These magnetic component parts may be integral with its other main face, on the side of the gap 3, as are the magnets 51, 52 shown on FIGS. 5A, 5B described later on. In this configuration, magnets 51, 52 are included in the support 1, they are embedded therein. Actually, it is preferable that the fixed magnetic part 5 associated with one of the supports and the abutted mobile magnetic part 4 be offset, i.e., in different planes. If, however, the fixed magnetic part is found on the side of the gap. 3, different thicknesses will preferably be given to the magnets of the fixed magnetic part and of the mobile magnetic part, in order to achieve this offset. Preferably, the mobile magnet will be thicker than the fixed magnet(s).

The mobile magnetic part 4 includes a magnet 40. It lacks any mechanical linkage with the fixed magnetic part 5. The amagnetic supports 1, 2 each include an abutment area 10, 20 for the mobile magnetic part 4. In the example of FIGS. 1A, 1B, the fixed magnetic part 5 contributes to delimiting the abutment areas 10, 20. Both magnets 51, 52 are found on either side of the abutment area 10. In any case, the abutment area 10, 11 and the fixed magnetic part 5 are distinct but close so that the interaction may occur. The abutment area 20 of the second support 2 is found opposite the abutment area 10 of the first support 1. The mobile magnetic part 4 is found either abutted against one of the supports 1, 2 or in levitation in the gap 3 between both supports 1, 2, without any contact, magnetically guided by the fixed magnetic part 5 at the very least.

The magnetic actuator also includes means 6 for triggering the displacement of the mobile magnetic part 4. The means 6 for triggering the displacement of the mobile magnetic part 4 have the function of changing the forces which interact on the mobile magnetic part 4 and of therefore changing the equilibrium of the fixed magnetic part/mobile magnetic part assembly. They initiate the displacement of the mobile magnetic part 4. The displacement is then due to the interactions between the fixed magnetic part 5 and the mobile magnetic part 4.

It is assumed in this example that the means 6 for triggering the displacement of the mobile magnetic part have a mechanical effect. They are of the pneumatic or hydraulic type. The first support 1 is provided with a port 7 which is found in the abutment area 10. One tries to have the mobile magnetic part 4 in a stable magnetic position move and be forcibly applied against the first support 1 in the abutment area 10 by the interaction exerted on it by the fixed magnetic part 5. It then closes up the port 7. Nothing can penetrate into the gap 3 through the port 7. When a fluid f is injected through the port 7 towards the gap 3 and when it has a sufficient pressure for displacing the mobile magnetic part 4, the latter moves and places itself in the abutment area 20, forcibly applied against the second support 2 (FIG. 1A). Fluid f may then penetrate into the gap 3 and flow sideways according to the dotted arrows. In this position, the mobile magnetic part 4 abutted against the second support 2, remains in interaction with the fixed magnetic part 5. If the pressure of the fluid f is no longer exerted sufficiently or if the pressure of the fluid f is reversed, the mobile magnetic part 4 returns to the high position, abutted against the first support and it closes up port 7 (FIG. 1B). This occurs when the geometrical characteristics of the magnets, their magnetization and their relative position in the gap, are properly adjusted.

The interaction between the fixed magnetic part and the mobile magnetic part has the effect of centering the mobile magnetic part in the abutment area. To enhance centering of the mobile magnetic part in the abutment area 10, 20 of at least one of the supports 1, 2, means may be provided for mechanically centering 8 the mobile magnetic part 4 at the abutment area 10, 20 of at least one of the supports 1, 2. The mobile magnetic part 4 and the relevant abutment area 10 may each be provided with a relief feature 80, 81, these relief features 80, 81 having conjugate shapes. These relief features may be chamfered or bevelled parts which are then substantially pyramidal or conical. These relief features 80, 81 cooperate when the mobile magnetic part 4 is abutted against the support 1, 2, it moves and fits into the support.

In FIGS. 1A, 1B, the fitting means are localized on the first support 1, displacement of the mobile magnetic part 4 may then occur from a high completely centered position to a low position and vice versa.

In the example of FIGS. 1A, 1B, the flanks of the mobile magnet 40 are the ones which are substantially pyramidal and the support 1 which bears the port 7 includes a cup with flanks which are also substantially pyramidal, the mobile magnet being placed in the cup of the support in the high position.

It might have been contemplated that the mobile magnet be borne by a base and that it be this base which includes the centering means. These relief features may easily be made by chemical etching notably when techniques used in microelectronics are used for making the magnetic actuator.

In the example of FIGS. 1A, 1B which represent a valve, the centering means 8 also have a fluid seal-off function when the mobile magnetic part 4 is in the high position. The fluid cannot enter the gap 3 as long as its pressure is not sufficient.

Instead of using means 6 for triggering the displacement of the mobile magnetic part 4, pneumatically with a mechanical effect, it is possible to use means with a magnetic effect. These means may generate a localized increase in temperature and thereby change the magnetic characteristics of the fixed magnetic part 5.

FIG. 2 illustrates this characteristic. In FIG. 2, the fixed magnetic part 5 is spread over both supports 1, 2. It includes two pairs of magnets respectively referenced as 51, 52, 53, 54, and each pair of magnets is integral with one of the supports 1, 2. By spreading the fixed magnetic part 5 over both supports 1, 2, it is easier to control the positioning of the abutted mobile magnetic part 4. More generally, the magnetic component parts, grouped pairwise are located on either sides of an abutment area.

The mobile magnetic part 4 is able to assume several stable magnetic positions, in each of these positions, it is abutted against a support 1, 2. These stable magnetic positions do not require any electric power supply, the mobile magnetic part is in magnetic interaction with the fixed magnetic part 5.

FIG. 2 shows that the magnets 51–54 of the fixed magnetic part 5 are each equipped on one of their faces with a heating resistor R. These resistors may be made by a conducting metal coating for example based on copper, silver, gold, aluminium, polysilicon. In this configuration, the means 6 for triggering the displacement of the mobile magnetic part 4 are spread over both supports 1, 2. It may be contemplated that they be localized on only one of them as in FIG. 4A.

By spreading the means 6 for triggering the displacement of the mobile magnetic part 4 over both supports 1, 2, it is easier to control its movement.

A fixed magnetic part 52-54 provided with such resistors R is made in a thermomagnetic material, the magnetic properties of which depend on temperature. A material with a low Curie point, for example less than or equal to 100° C., may be used, this material is magnetic for a lower temperature than its Curie point and amagnetic for a higher temperature. It is also possible to use a material for which ferromagnetic properties are obtained above a so-called transition temperature.

Heating should not perturb the magnetic properties of the mobile magnetic part 4. For example, the magnet 40 of the mobile magnetic part 4 may be made in a material for which the Curie point is higher than that of the magnets 51, 52 of the fixed magnetic part 5, or it may be thermally isolated from the fixed magnetic part 5.

Instead of achieving the heating with a resistor R, irradiating the fixed magnetic part 5 with a light beam (for example from an infrared diode or laser) in order to heat it up, may be contemplated. It is also possible to have a current directly flow into the fixed magnetic part 5 to heat it up.

As soon as the movement of the mobile magnetic part 4 has been initiated, since it leaves by magnetic guiding and abuts against one of the amagnetic supports, heating may be interrupted, there is no longer any power consumption. When the mobile magnetic part 4 abuts on one of the supports 1, 2, power consumption is also zero.

In FIG. 2, the magnetic actuator is microvalve. Each of the supports 1, 2 includes a port 7 for having a fluid f1, f2, penetrate into or flow out from the gap 3 between both supports 1, 2. Depending on the position of the mobile magnetic part 4 only one of the fluids f1 or f2 may penetrate into or flow out of the gap 3. The magnetic part prevents the penetration of the other fluid.

Instead of having means 6 for triggering the displacement of the mobile magnetic part 4 that change the magnetic characteristics of the fixed magnetic part 5, it is possible that they create a magnetic field which changes the magnetic equilibrium between the fixed magnetic part 5 and the mobile magnetic part 4 and accordingly the equilibrium position of the mobile magnetic part 4.

FIG. 3 shows in a top view, the magnetic field lines which are established around the magnet 40 of the mobile magnetic part 4 with the magnetization direction schematized by an arrow. It is assumed that the magnet 4 abuts on the second support 2. In this example, it has the shape of a rectangular parallelepiped and its poles are located at the ends of its major sides.

In order to trigger the displacement of the mobile magnetic part 4, while it is in a stable magnetic position abutted against one 2 of the supports, it must be submitted to a force perpendicular to the support (i.e., perpendicular to the sheet, here) which is larger than and opposed to the force which maintains it in abutment.

When an electric current is caused to flow in an electric conductor in the vicinity of a magnet, such that the current is perpendicular to the magnetic field, a force both perpendicular to the current and to the magnetic field is generated according to Laplace's Law. The direction of the force depends on the direction of flow of the current if the magnetization direction of the magnet is set.

The means 6 for triggering the displacement of the mobile magnetic part 4 are formed with two distinct conductors 61, 62, each surrounding a pole of the magnet 40. Arrows show the direction of flow of current I in conductors 61, 62, so that a force is applied on the magnet 40, aimed at detaching it from the second support 2.

Figure 4A:
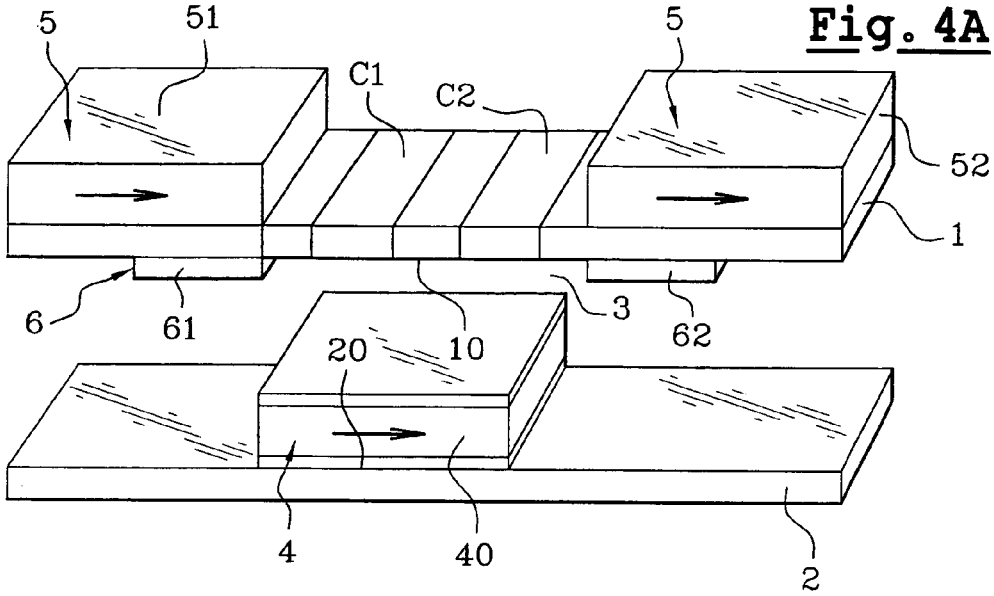
FIGS. 4A, 4B, 4C respectively show a magnetic actuator according to the invention operating as an electrical relay, as an electric switch, and a top view of the upper coils of the means for triggering the displacement of the mobile magnetic part.

Instead of using two conductors 61, 62 in an open loop as in FIG. 4A, each at one end of the magnet 40, one or more looped conductors with one or more turns might be used in order to obtain this same current flow. It is assumed that this is the case in FIGS. 4B, 4C with a pair of coils (610, 620), (630, 640) integral with each of the supports 1, 2. In the example of FIG. 3, maximum efficiency is achieved when each pole of the magnet 40 is edged by a substantially semicircular conductor. The positioning and the shape of the conductor, the intensity of the current and its direction are adjusted in order to obtain a desired force. The conductor may be made exactly like the resistor by a coating based on a conducting metal.

It is assumed that the magnetic actuator of FIG. 4A is an electrical relay. One of the supports 1, 2 includes a pair of electrical contacts C1, C2 insulated from one another in the abutment area 10. The mobile magnetic part 4 itself includes an electrical contact C which electrically connects both electrical contacts C1, C2 of the pair when the mobile magnetic part 4 abuts against the thereby equipped support 1.

The pair of electrical contacts C1, C2 is included in an electrical circuit (not shown) which is closed when the mobile magnetic part 4 abuts against the thereby equipped support 1 and open when the mobile magnetic part 4 abuts against the other support 2. The other support 2 does not include any fixed magnetic part or means for triggering the displacement of the mobile magnetic part 4.

Figure 4B:
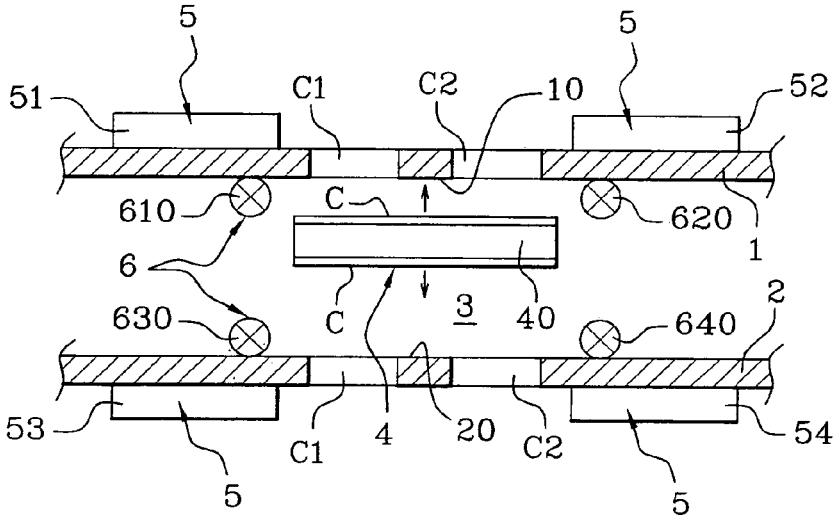

As in FIG. 4B, a pair of electrical contacts C1, C2 may be placed on each of the supports 1, 2 and equip both main faces of the mobile magnetic part 4 of an electrical contact C. According to its position, the mobile magnetic part 4 closes the upper electrical circuit or the lower one.

A double electrical relay or an electrical switch are then achieved if an electrical contact of one of the pairs is connected to an electrical contact of the other pair.

Figure 4C:
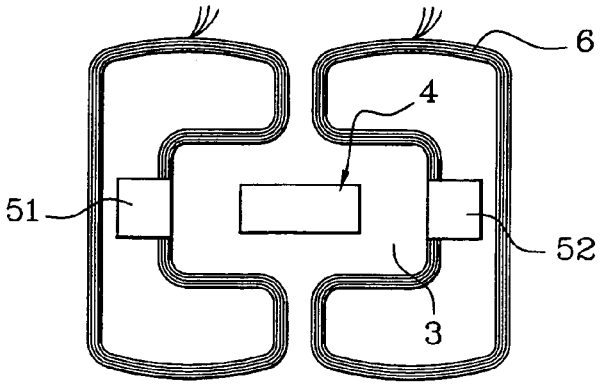

In FIG. 4C, the pair of coils 610, 620 and the pair of magnets 51, 52 integral with the first support 1 and the mobile magnetic part 4 are schematically illustrated in a top view.

Figure 5A:
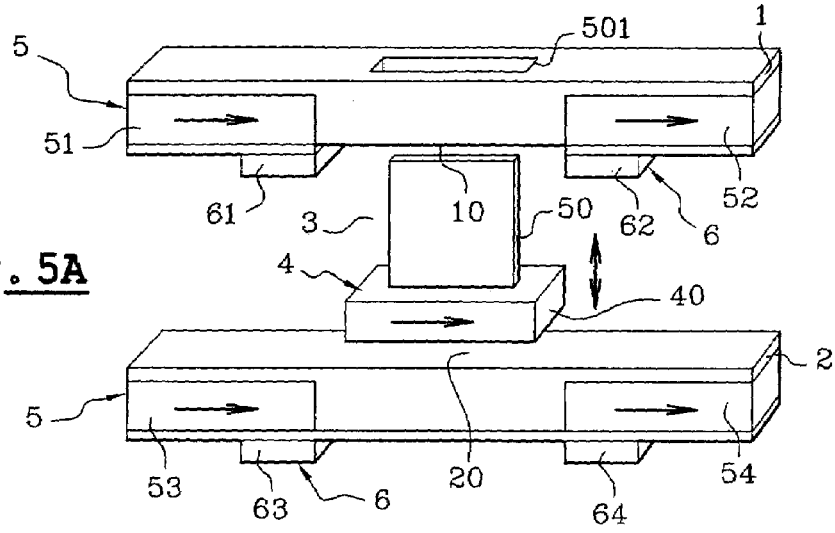
FIGS. 5A and 5B show in two different positions, a magnetic actuator operating as an optical relay.
Figure 5B:
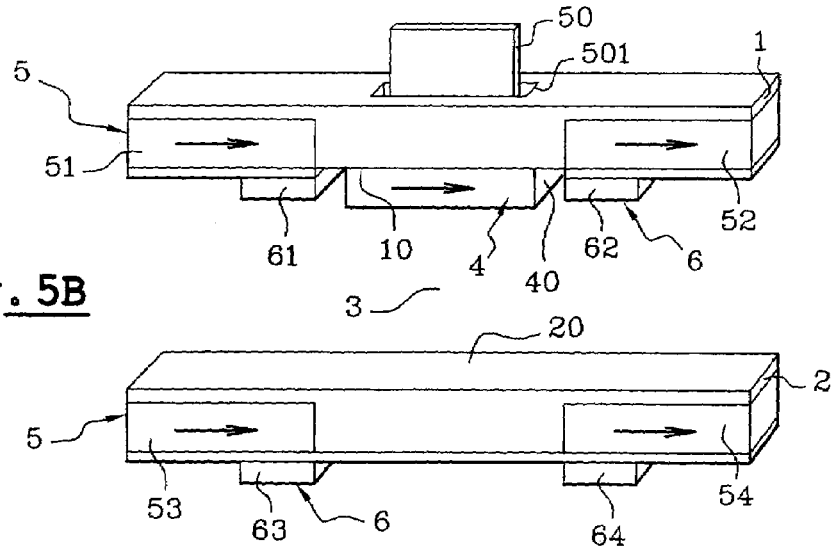

FIGS. 5A, 5B now show a magnetic actuator with a relay or optical switch function in the levitation position and in the stable working position, respectively. The mobile magnetic part 4 is provided with a mirror 50. When the mobile magnetic part 4 abuts on the second support 2, the mirror 50 is confined into the gap 3 between both supports 1, 2. When the mobile magnetic part 4 abuts against the first support 1, the mirror 50 passes through a slot 501 borne by the first support 1 and exits the gap 3, emerges from the other side of the first support 1. This mirror 50 when it is in the high position may then deflect a light beam which is not deflected when the mirror is in the low position. The light beam is not illustrated in order not to overload the figures.

Figure 6A:
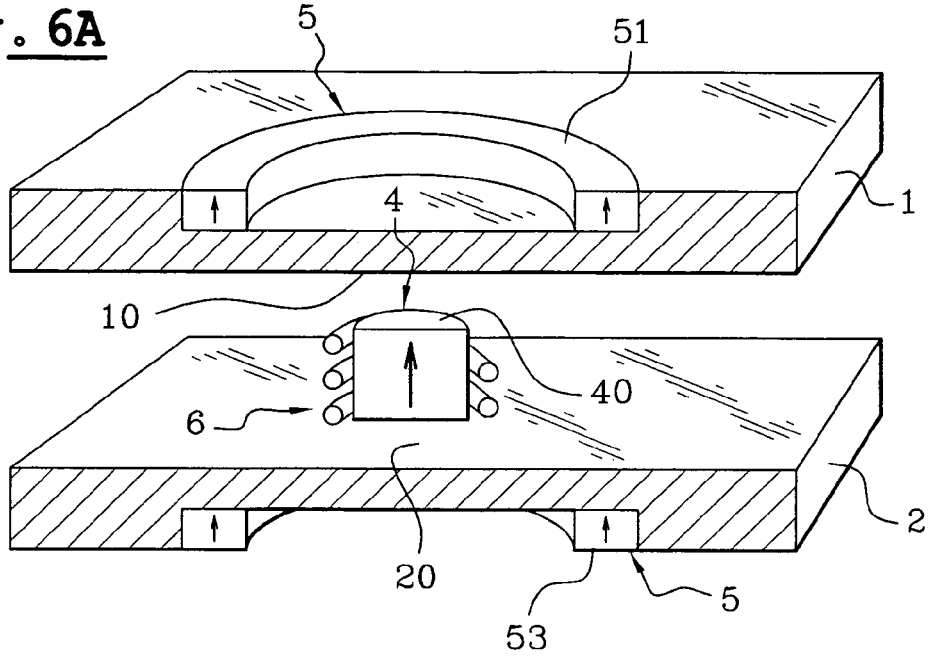
FIGS. 6A, 6B show two magnetic actuators according to the invention, the fixed magnetic part of which are formed by a single magnetic component part per support.
Figure 6B:
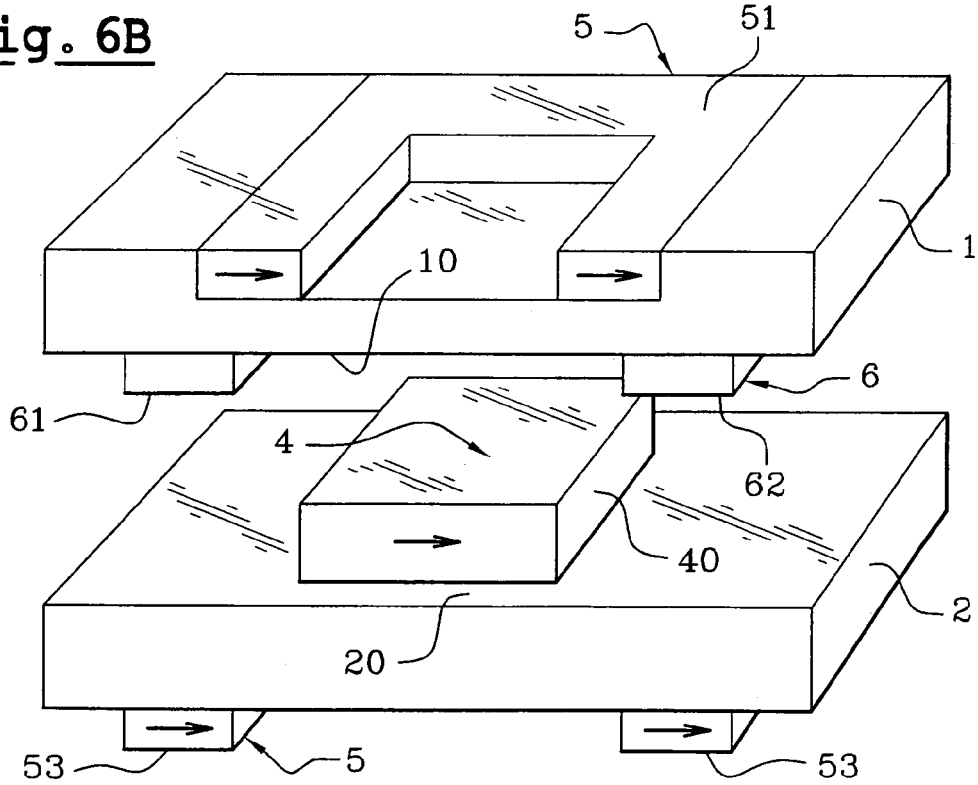

In FIGS. 6A, 6B, the supports 1, 2 each accommodate a single fixed magnetic component part 51, instead of several of them in the preceding examples. This magnetic component part may totally or partly surround the abutment area of the support. Only one of these supports might have been provided with such a magnetic component part.

Two substantially annular magnetic component parts 51, 53 are seen in FIG. 6A which is a sectional view. Each magnetic component part surrounds an abutment area 10, 20. Another difference from what has been described earlier, is that the mobile magnetic part 4 is now substantially cylindrical. The means 6 for triggering the displacement of the mobile magnetic part 4 in the example of FIG. 6A, assume the shape of a coil, the winding axis of which is parallel to that of the mobile magnetic part 4. The direction of magnetization of the fixed and mobile magnetic parts is the same, but instead of being in the plane of the supports 1, 2, substantially perpendicular to the displacement as in the examples earlier, it is substantially perpendicular to the plane of the supports and substantially parallel to the displacement.

In this example, the fixed magnetic parts 51, 53 are embedded in supports 1, 2 and in the abutment areas 10, 20, the supports are tapered.

A substantially U-shaped magnetic component part 51 integral with support 1 is seen in FIG. 6B. It is embedded on the side of its upper face. Another magnetic component part 53 is integral with the other support 2. It is assumed that it is also U-shaped. This second magnetic component part 53 might have been omitted. Also in this example, one of the supports 1, 2 is tapered at an abutment area 10. The means 6 for triggering the displacement of the mobile magnetic part 4 are integral with support 1.

Figure 7:
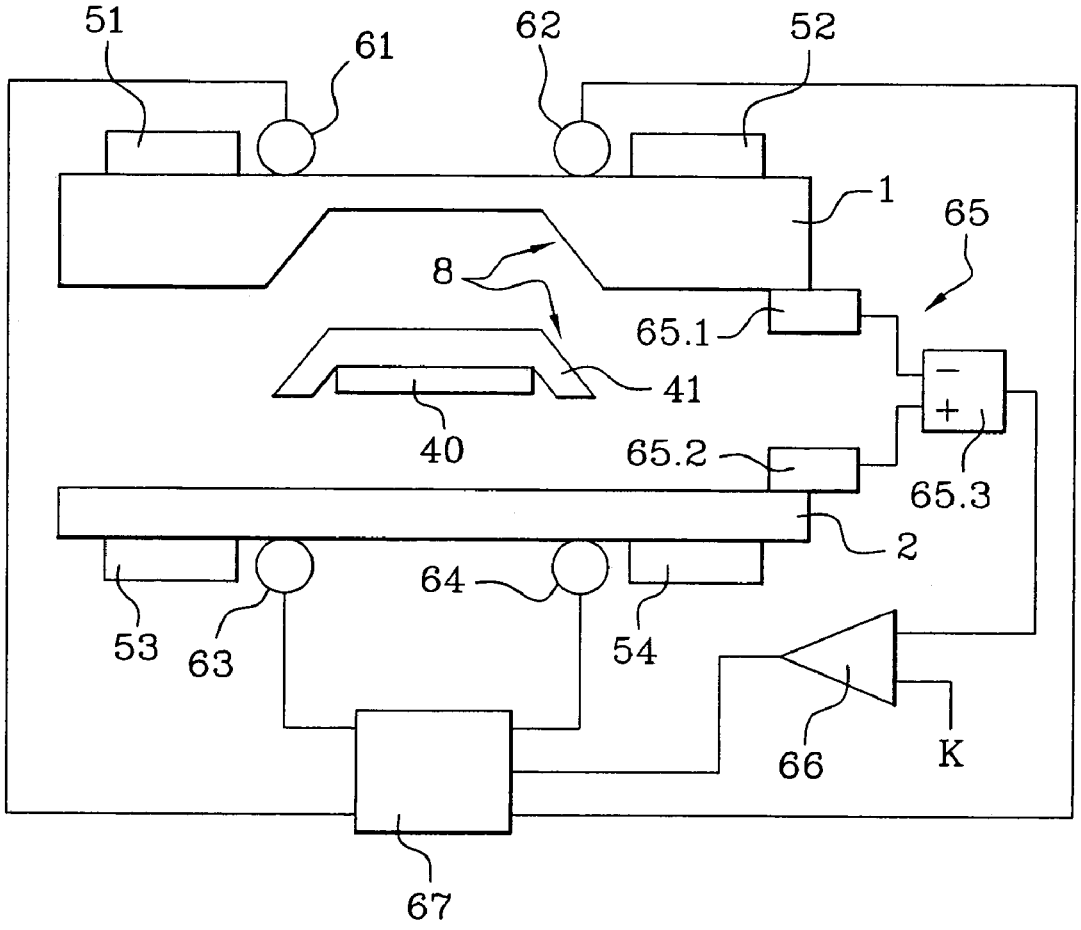
FIG. 7 shows a magnetic actuator according to the invention operating as a positioner.

The magnetic actuator according to the invention may have a positioner function. The means 6 for triggering the displacement of the mobile magnetic part is then also used for maintaining the mobile magnetic part 4 in a fixed position in levitation. Instead of sending a current pulse into conductors 61 to 64, the current may be controlled according to the position of the mobile magnetic part 4. FIG. 7 illustrates this alternative.

A device 65 which detects the position of the mobile magnetic part 4, may be used. The signal delivered by this device is compared with a set value K in a comparator 66 and the result of the comparison is used for controlling a provided power supply source 67 for powering the conductors 61–64. The device 65 which detects the position of the mobile magnetic part 4 may assume the form of two capacitive sensors 65.1, 65.2, each localized on one of the supports 1, 2. They measure the capacitances between the relevant support 1, 2 and the mobile magnetic part 4. A differentiator device 65.3 receives signals from both capacitive sensors 65.1, 65.2, produces their difference and delivers the signal representative of the mobile magnetic part's 4 position to the comparator 66.

Soft magnetic materials, hard magnetic materials, magnetic materials with hysteresis, diamagnetic materials, superconducting materials, these materials being taken alone or combined, may be used for producing the fixed magnetic part 5. Soft magnetic materials such as iron, nickel, iron-nickel iron-cobalt, iron-silicon alloys are magnetized depending on an induction field to which they are submitted. Hard magnetic materials correspond to magnets such as ferrite magnets, samarium-cobalt magnets, neodymium-iron-boron magnets, platinum-cobalt magnets. Their magnetization is not very dependent on the external magnetic field. The materials with hysteresis, for example of the aluminium-nickel-cobalt (AlNiCo) type, have properties which are between those of soft magnetic materials and those of hard magnetic materials. They are sensitive to the magnetic field in which they are found. As for diamagnetic materials such as bismuth or pyrolitic graphite, their magnetization is collinear with the magnetic induction field but of opposite direction. Superconducting materials might be niobium-titanium (NbTi), yttrium-barium-copper-oxygen (YBaCuO) alloys for example.

The mobile magnetic part 4 may be made in ferrite, in samarium-cobalt, in neodymium-iron-boron, in platinum-cobalt, for example.

Magnetic materials with a low Curie point which are suitable for making the fixed magnetic part 5, are manganese-arsenic (MnAs), cobalt-manganese-phosphorus (CoMnP), erbium-iron-boron (ErFeB) alloys, for example. Iron-rhodium (FeRh) alloys are also suitable for the fixed magnetic part 5, they become ferromagnetic above a transition temperature. This transition is clear and therefore only requires little thermal energy. The transition temperature may be adjusted by adapting the chemical composition of the alloy.

Figure 8A:
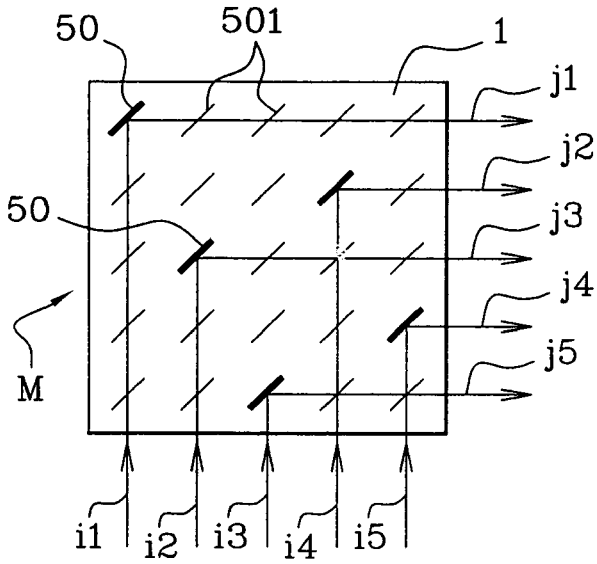
FIGS. 8A, 8B show magnetic actuators according to the invention arranged as a matrix and sharing at least one same support.
Figure 8B:
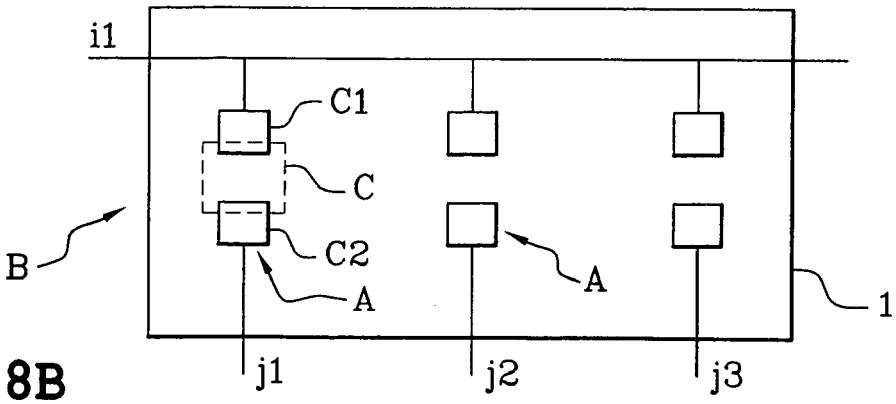

Several thereby described magnetic actuators may share at least a common support. Reference may be made to FIGS. 8A, 8B.

In FIG. 8A, the different actuators are optical relays like those of FIGS. 5A, 5B, they are arranged as a matrix M and their first support 1 is common to all of them. An optical multiplexer is thereby obtained. The magnetic actuators are only visible by their mirror 50 when it emerges from the gap between both supports; otherwise their position is materialized by slot 501. They are at the crossing between n conductors of columns i1–i5 and m conductors of lines j1–j5 (n and m are integers, n and m may be either different or not). In this way, signals propagating on a web formed with the n conductors of columns i1–i5 may be switched to the m conductors of lines j1, j2, j3, j4, j5. These signals may be electrical or optical signals according to the nature of the actuators. The conductors of lines and columns may be electrical conductors, optical fibers or simply light beams. Because of the bistability of the actuators of matrix M, the latter may be programmed and retain its configuration without it being necessary to power it electrically. The actuators A may be grouped together in a particular matrix B as in FIG. 8B with a conductor of line i1 and several conductors of columns j1–j3. By connecting a bus on the conductor of line i1, the signals which it conveys may be orientated towards the different conductors of columns j1–j3, according to the state of different actuators A. It is assumed that in this configuration, the actuators are electrical relays as the one of FIG. 4A.

An exemplary magnetic actuator according to the invention will now be described by providing geometrical characteristics and explaining a possible method for positioning its fixed and mobile magnetic parts. The magnetic actuator is illustrated in FIG. 9A.

A minimum value of the force Fz which is applied on the mobile magnetic part 4 for maintaining it forcibly applied and abutted against one of the supports 1, 2 is imposed so that the actuator may for example have sufficient impact strength. One tries to have the mobile magnetic part 4 always assume the same stable and centered magnetic position relatively to the fixed magnetic part 5 when it abuts against one of the supports 1, 2. Deviation of the mobile magnetic part 4 along the x axis or along the y axis is not wanted during the displacement. Axes x, y and z are illustrated in the figure. If it is shifted along the x direction or along the y direction, the mobile magnetic part 4 should oppose this displacement and resume its centered and stable magnetic position in the abutment area 10, 20. The mobile magnetic part should have good side stability in the high or low position.

The inventors have realized that for a fixed magnetic part 5 and a mobile magnetic part 4 with given characteristics, for a given force Fz maintaining them against one of the supports 1, 2, in order to achieve the stable and centered magnetic position, both the sep interval separating, along x, the fixed magnetic part from the mobile magnetic part and the gapz interval separating, along z, the fixed magnetic part 4 from the mobile magnetic part 5, needed to be adjusted properly when the mobile magnetic part abuts against the support 1.

Figure 9A:
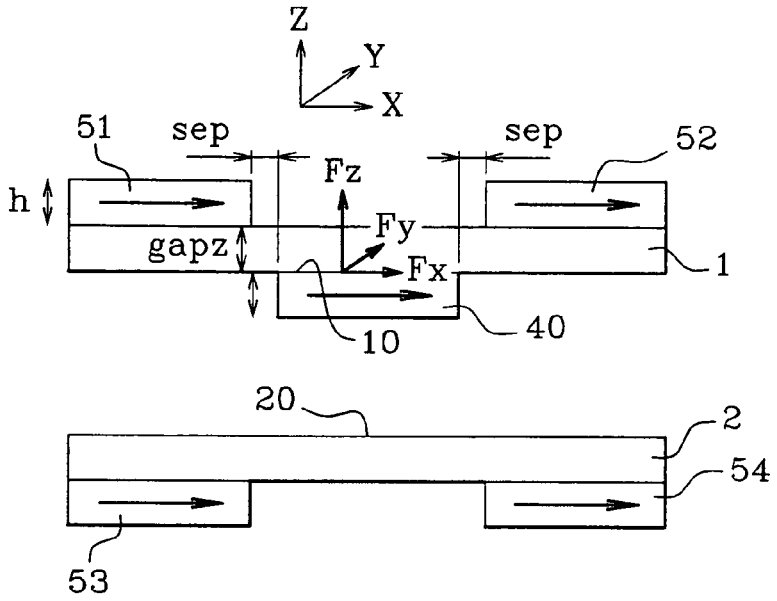
FIG. 9A shows a magnetic actuator according to the invention.

It is assumed that in this example, illustrated in FIG. 9A, the fixed magnetic part 5 is spread over both supports and includes two pairs of identical magnets (51, 52), (53, 54). The mobile magnetic part 4 itself includes a magnet 40. For the sake of simplicity, it is assumed that the magnetization directions of all the magnets are collinear and have the same direction. Of course, it is possible that this be not the case but the positioning of the magnets becomes more complicated.

The means for triggering the displacement of the mobile magnet are not illustrated in order not to overload the figure.

One starts with selecting the dimensions of the magnets, their magnetization and the path of the mobile magnet. This selection is notably conditioned by the overall bulkiness that the magnetic actuator should have. One of the pairs of fixed magnets 51, 52 and the mobile magnet 40 relatively to this pair of fixed magnets are positioned arbitrarily. Initial values of sep and gapz are determined. By means of the method described in the article "3D analytical calculation of the forces between two cuboidal magnets, JAKOUN Gilles and YVONNET Jean-Paul, vol. MAG-20, No.5, September 1984" the forces Fx, Fy, Fz which are applied to the mobile magnet 40 are calculated. The force Fz which is applied to the mobile magnet 40 when it abuts on the first support 1 may then be determined. If the force Fz is not in the imposed range, sep and/or gapz and/or the geometrical characteristics of the magnets and/or their magnetization are changed in order to adjust its value. The more gapz and sep are reduced, the more the force Fz increases. Both fixed magnets may be brought closer and/or the thickness of the support 1 may be reduced since, in this example, the fixed magnets 51, 52 are placed on the side of the support 1 and the abutted mobile magnet 40 on the other side of the support 1. Oppositely, the thickening of the support 1 reduces the Fz force. When a suitable value for Fz has been reached, it should then be determined whether the pair of values, sep, gapz, which give the suitable force Fz, leads to a stable and centered magnetic position in abutment. The value of the Fx force depending on its position along x and the value of the Fy force depending on its position along y will now be determined. Indeed, it is not sufficient that in abutment, Fx=0 with x=0 and Fy=0 with y=0; it is also required that the slope of curve Fx(x) decrease for x=0 and that the slope of curve Fy(y) decrease for y=0. These decreasing slopes are the ones which condition stability.

Figure 9B:
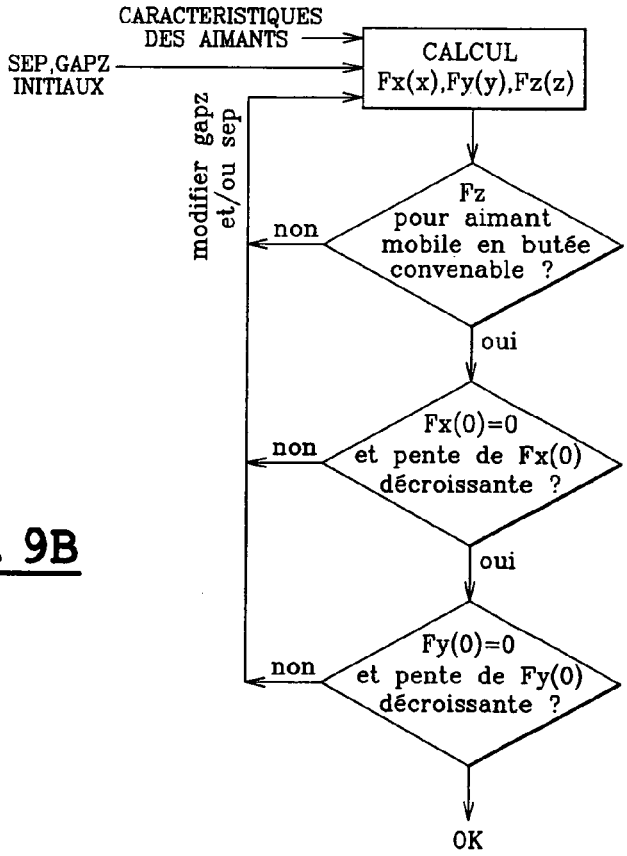
FIG. 9B is a flow chart for explaining how to position the magnets of the actuator of FIG. 9A in order to obtain two stable magnetic positions of the mobile magnetic part in a very special case.

With the pair of values, sep and gapz, which give a suitable Fz force, the x and y stability conditions are verified. If one of either conditions is not observed, at least one of the values of sep and gapz is adjusted. Fz, Fx and Fy are recalculated as shown in the flow chart of FIG. 9B, as described earlier, by adjusting sep and gapz until a couple of satisfactory values is obtained.

If the holding force Fz on the other support 2 is identical, the magnets 53, 54 of the other pair will be positioned with the same intervals sep and gapz.

It may be imposed that the value of the holding force Fz be different from one support to the other. The same calculations are again performed in order to position the other pair of fixed magnets 53, 54, relatively to the mobile magnet 40, in order to obtain a suitable Fz force and stability conditions, when the mobile magnet 40 abuts on the other support 2.

On the flow chart, sep and gapz were adjusted from Fx and then from Fy. Of course, it is possible to do the opposite. It would also have been possible to change the magnetic and geometrical characteristics of the magnets.

As an example, tests were carried out with fixed magnets 51–54 with a volume of 60×40×5 cubic micrometers, a mobile magnet 40 of 160×40×5 cubic micrometers and a magnetization of 0.6 T. The weight of the mobile magnetic part is about $2.10^{-8}$ N, the force Fz for holding the mobile magnet in a stable magnetic position against the first support 1 is about $4.10^{-7}$ N. The forces provided by the means for triggering the displacement of mobile magnetic part are a few $10^{-6}$ N, the switching time is of a few milliseconds and the path of the mobile magnetic part is 200 micrometers.

In this particular case, it is noticed that the following relationship should be satisfied to obtain the stable magnetic position:

gapz+h larger than D.sep with h being the height of the fixed and mobile magnets and D being between 1 and 1.5.

Figure 9C:
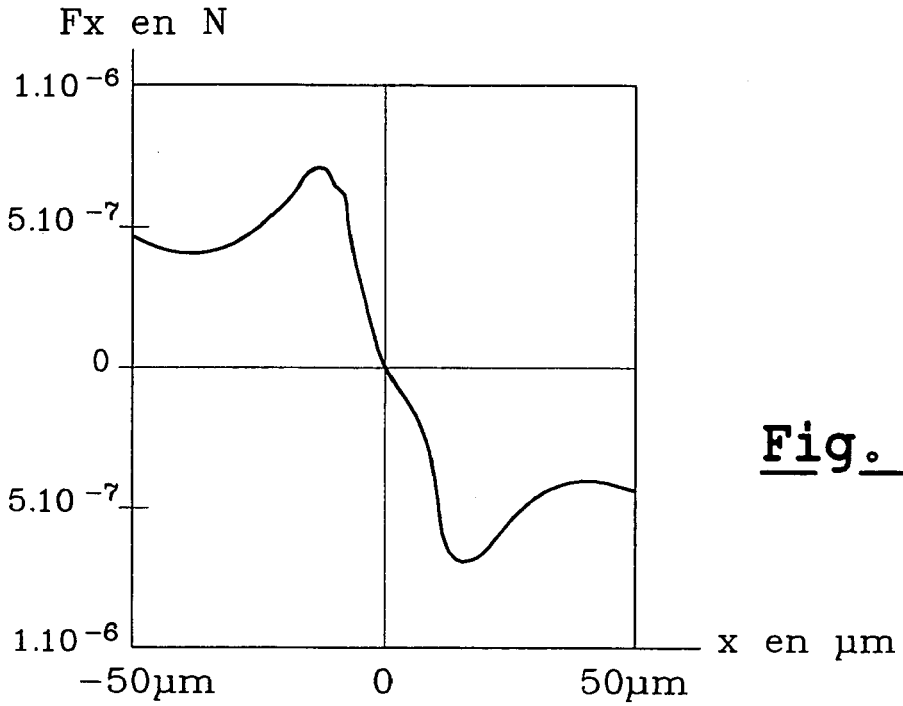
FIG. 9C illustrates the force Fx which is applied to the abutted mobile magnetic part depending on its position along the x axis when the actuator has a desired configuration with two stable abutted magnetic positions.
Figure 9D:
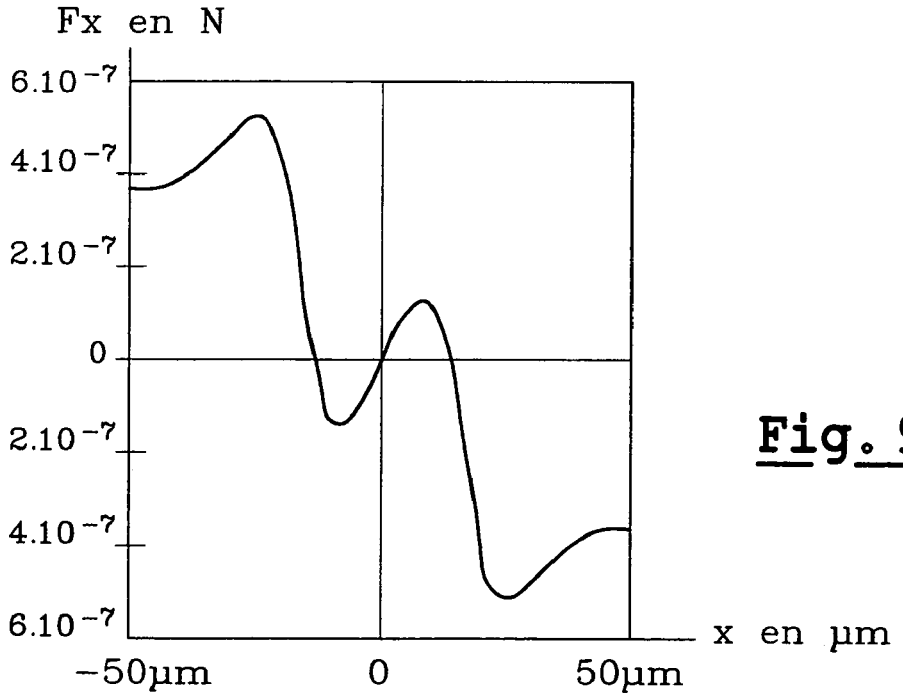
FIG. 9D illustrates the force Fx which is applied on the abutted mobile magnetic part, depending on its position along the x axis when the actuator has a configuration to be avoided, with two unstable abutted positions.

FIGS. 9C, 9D show variations of the force Fx versus x when the actuator has the sought-after stable magnetic position and when it does not have it.

The stable magnetic position was obtained with:

gapz=7 micrometers sep=5 micrometers

An unstable position was obtained with gapz=7 micrometers sep=10 micrometers.

An example of a method for producing a microtechnological actuator according to the invention will now be described. The fixed magnetic part 5 of the actuator includes two pairs of magnets (51, 52), (53, 54), one integral with the first support 1 and the other integral with the second support 2. The mobile magnetic part 4 of the actuator includes a magnet 40 integral with a face of a base 41, this base 41 bears a mirror 50 on its other face. The means 6 for triggering the displacement of the mobile magnetic part 4 are achieved by two pairs of conductors (61, 62), (63, 64), each pair being integral with one of the supports 1, 2. In the figures, only one actuator is seen but the advantage of this method is the possibility of making several of them simultaneously; they all share at least one common support.

Figure 10A:
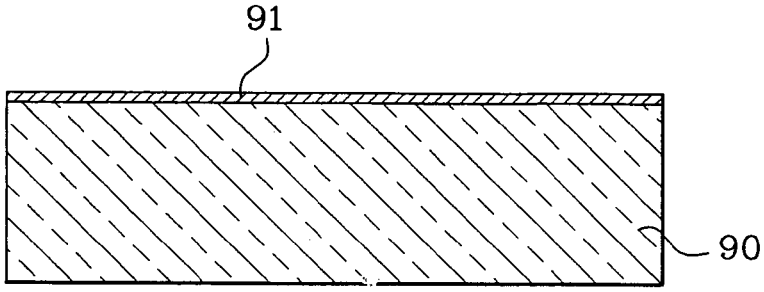
Figure 10B:
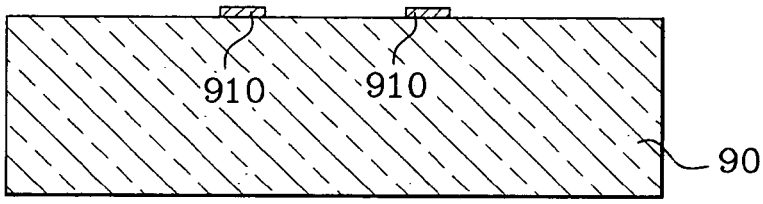

One starts with a first amagnetic substrate 90, for example in semiconducting material such as silicon or gallium arsenide (FIG. 10A). This first substrate 90 after processing will lead to the first amagnetic support 1, the upper one. For example, a titanium sacrificial layer 91 is deposited on silicon. This sacrificial layer 91 will be used for delimiting the base 41 of the mobile magnetic part 40. It is etched in order to only leave a frame 910 along the perimeter of the base (FIG. 10B). This frame 910 is called a sacrificial frame subsequently.

Figure 10C:
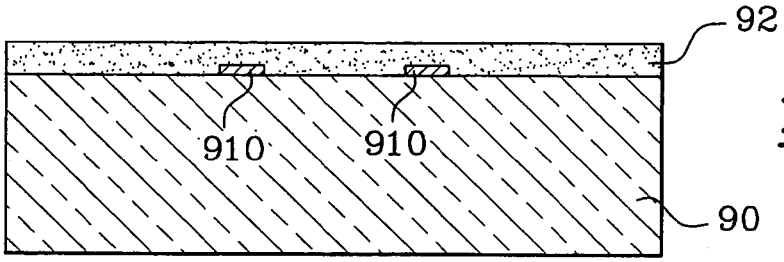

A first dielectric layer 92 for example a silicon oxide layer, which will be used for making one of the pairs of magnets 51, 52, of the fixed magnetic part 5 (FIG. 10C), is deposited on the first substrate 90 over the sacrificial frame 910. This first dielectric layer 92 is then planarized.

Figure 10D:
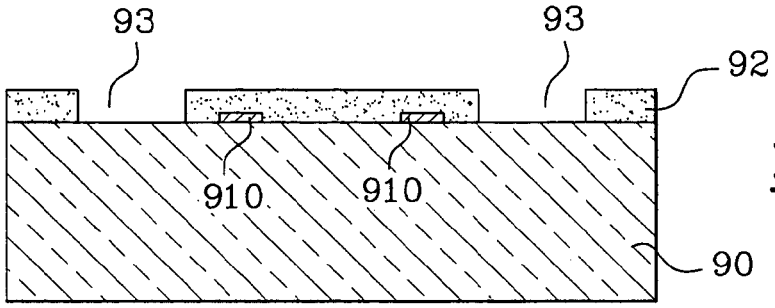
Figure 10E:
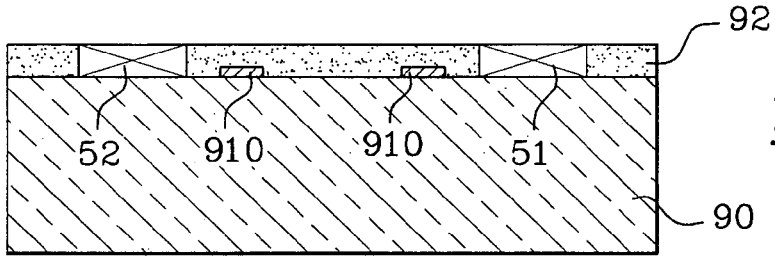

The geometry of the pair of magnets 51, 52 is delimited photolithographically. A resin (not referenced) is used for this. Casings 93 are etched in the first dielectric layer 92 for the pair of magnets 51, 52 (FIG. 10D). The casings are located on either side of the sacrificial frame 910. Etching may be dry etching. Etching stops on the first substrate 90. The resin is removed. The magnets 51, 52 are deposited in the casings 93 (FIG. 10E). This deposition may be made electrolytically. The material used may be cobalt-platinum. A step is carried out for planarization of the fixed magnets.

Figure 10F:
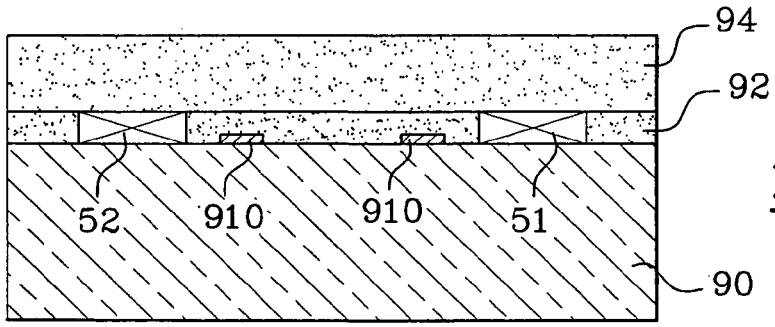

A second dielectric layer 94 for example a silicon oxide layer, in which the pair of conductors and the magnet of the mobile magnetic part (FIG. 10F) will be found, is then deposited on the first dielectric layer 92. After planarization of this second dielectric layer 94, the geometry of the conductors and of the pads which terminate them and that of the magnet of the mobile magnetic part are delimited photolithographically. For this, a resin is used (not shown). A casing 95 for the magnet of the fixed magnetic part and casings 96 for the conductors of the pair (FIGS. 10G1 and 10G2) and casings 96.1 for the pads which terminate them (FIG. 10G2) are etched into the second dielectric layer 94. The casings 96 for the conductors are found on either side of the casing 95 for the magnet of the mobile magnetic part. The casings 96 for the conductors are found substantially on top of the magnets 51, 52 of the pair. Etching may be dry etching. The casings 96.1 for the pads are on either side of the casings 96 for the conductors.

The magnet 40 of the mobile magnetic part is deposited in the appropriate casing 95. This is completed by a step for planarization of the magnet 40 (FIG. 10H1 and FIG. 10H2).

The conductors 61, 62 are deposited in the appropriate casings 96 and the pads 62.1, 62.2 in the casings 96.1. This is completed by a step for planarization of the conductors 61, 62 and of the pads 61.1, 62.1. This deposition may be performed with copper (FIG. 10I1 and FIG. 10I2) electrolytically.

One or more trenches 97 are etched in both dielectric layers 92, 94, until they reach the sacrificial frame 910. These trenches delimit the flanks of the base of the mobile magnet 40 (FIG. 10I1 and FIG. 10I2). This etching may be chemical etching. These trenches 97 may configure the flanks of the base with the relief features of the centering means.

One starts with a second amagnetic substrate 100, in a semiconducting material, such as silicon, covered with a first dielectric layer 101, for example a silicon oxide layer. This second substrate 100 after processing will lead to the second amagnetic support 2, the lower one. For example, an oxidized bulk silicon substrate or a SOI substrate may be used directly.

In the first dielectric layer 101, casings 102 are etched which will receive the other pair of magnets of the fixed magnetic part (FIG. 11A). Etching stops on the second substrate 100. The second pair of magnets 53, 54 is deposited in the same way as the first pair. This is completed by a step for planarization of the magnets (FIG. 11B).

A second dielectric layer 103, for example a silicon oxide layer, is then deposited on the first layer 101, this second dielectric layer 103 should receive the conductors of the second pair of conductors. In this second dielectric layer 103, casings 104 are etched for the conductors of the second pair of conductors (FIG. 11C1) and casings 104.1 for the pads terminating the conductors (FIG. 11C2). The conductors 63, 64 are deposited in the casings 104 in the same way as for the first substrate (FIG. 11D1). Pads 63.1, 64.1 are also deposited (FIG. 11D2). This is completed by a step for planarization of the conductors 63, 64 and of the pads 63.1, 64.1 (FIG. 11D1 and FIG. 11D2).

The first substrate 90 as obtained in FIG. 10I1, may then be assembled by turning it upside down, with the second substrate 100 as obtained in FIG. 11D1, by inserting between both of them, dielectric spacers 110 which contribute to delimiting a gap 3 in which the mobile magnetic part will be able to move (FIG. 12A1). During this assembly which is performed adhesively, dielectric layers 92, 94 and 101, 103, face each other, whereas the semiconducting substrates 90, 100 are in opposition. One manages to have the magnets 51, 52 and 53, 54, of both pairs aligned pairwise and have the conductors 61, 62 and 63, 64 of both pairs aligned pairwise.

The first substrate 90 as obtained in FIG. 10I2 may be assembled in the same way, by turning it upside down, with the second substrate 100 as obtained in FIG. 11D2, by inserting beads 112, in a meltable material, between both of them. These meltable beads 112 are then annealed. They contribute to delimiting the gap 3 in which the mobile magnetic part will be able to move (FIG. 12A2). They also allow an electrical contact to be established between the conductors 62, 61 of the substrate 90, and the conductors 63, 64 of the substrate 100, via the pads 62.1, 61.1 and 63.1, 64.1. As earlier, one manages to have the magnets of both pairs aligned pairwise, the conductors of both pairs and the pads being also aligned pairwise.

The mirror 50 may be made with this first semiconducting substrate 90. Its thickness, which may be adjusted, will correspond to the height of the mirror 50. Etching of one or several trenches 111 is performed in the first semiconducting substrate 90 in order to delimit the flanks of the mirror 50, and form the slots into which it will slide when the mobile magnetic part will be forcibly applied against the first support. This etching stops on the first dielectric layer 92. The sacrificial frame 910 is then removed by etching; this leads to the release of the base 41 of the mobile magnet 40 and of the mirror 50 (FIGS. 12B1 and 12B2). Tapering of the first substrate is performed on either side of the mirror so that the mirror in the high position protrudes from the top of the substrate which surrounds it and is concealed in the low position. The magnet 40 and its base 41 are able to move in the gap 3.

One first makes sure that the magnets 40, 51–54 are properly magnetized as otherwise a suitable interaction would not be obtained between the mobile magnet 40 and the pairs of magnets 51, 52 and 53, 54 of the fixed magnetic part 5. If an intervention is necessary, the magnetization may be produced by having a current flow into the conductors 61–64.

Figure 13A:
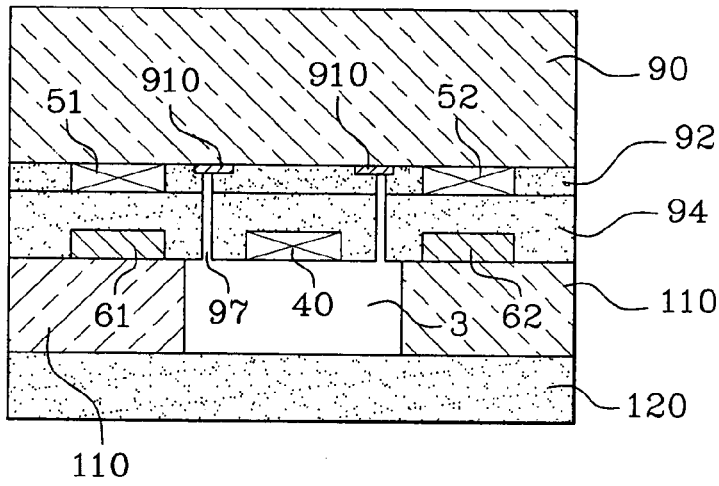
FIGS. 13A, 13B show the step for assembling the first support of FIGS. 10 with a second support without any magnet, nor conductor, and the step for releasing the mobile magnetic part.
Figure 13B:
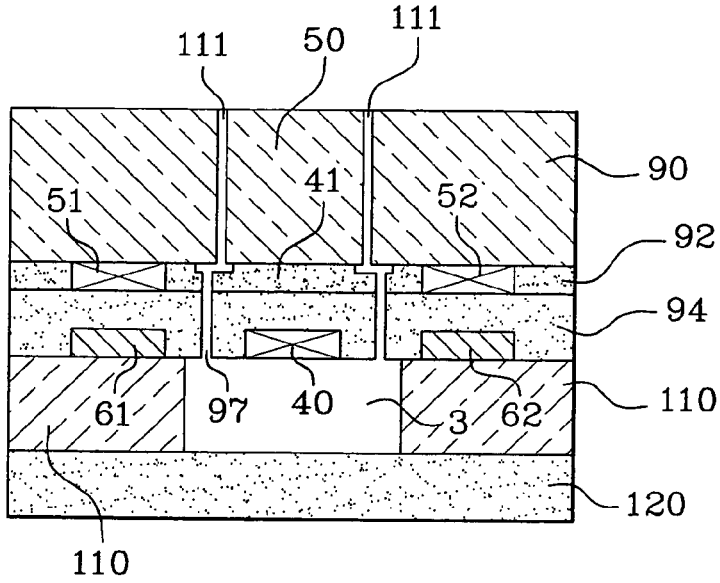

If the fixed magnetic part 5 and the means 6 for triggering the displacement of the mobile magnetic part are borne only by the first support 1, the steps from FIGS. 10 are carried out on the first substrate but not the steps from FIG. 11. One is limited to assembling with the first substrate, as obtained in FIG. 10I, a second dielectric amagnetic substrate 120 for example a silicon oxide substrate, by inserting spacers 110 between them (FIG. 13A). Conducting beads might be inserted but this is not illustrated in order not to multiply the number of figures. The mirror 50 and the release of the mobile magnetic part 4 would be achieved as described earlier in FIGS. 12B1 and 12B2 (FIG. 13B).

The microtechnological manufacturing of such actuators with a similar method may easily be contemplated, by starting with glass, ceramic or plastic dielectric substrates, for example.

The magnetic actuator according to the invention, if it occupies a volume larger than about one cubic centimeter, is liable to be sensitive to the external environment such as vibrations or impacts. Its performances are likely not to be optimal in such a perturbed environment. On the other hand, unexpectedly, with smaller dimensions, its performances are largely improved regardless of the environment. The interaction between the mobile magnetic part and the fixed magnetic part is favorable and does not bring about any deterioration of the performances as in the case of a more bulky actuator.

The main characteristics of a actuator according to the invention are the fact of having a relatively high displacement speed, a capacity of exerting large mass forces and large displacements relatively to its size. The mobile magnetic part in the stable magnetic position abutted against one of the substrates, withstands impacts. The actuator consumes very little power and this only during displacement of the mobile magnetic part and not in the stable magnetic position when the mobile magnetic part is abutted against one of the substrates.

The fact that the displacement of the mobile magnetic part is performed substantially perpendicularly to the supports is very attractive in matrix applications. The surface of such matrices may be relatively small as compared to the number of mobile parts. This is also attractive for all applications with fluid.

Although several embodiments of the present invention have been illustrated and described in detail, it will be understood that different changes and alterations may be made without departing from the scope of the invention. The magnetization of the fixed magnetic part and that of the mobile magnetic part have been illustrated as having the same direction. It is possible that this be not the case. This direction follows the major sides of the magnets which are in the form of a rectangular parallelepiped.

The invention claimed is:

1. A magnetic actuator comprising:

a mobile magnetic part;

a fixed magnetic part;

means for triggering displacement of the mobile magnetic part relative to the fixed magnetic part;

wherein at least two amagnetic supports, placed in different planes, delimit a gap between them, the fixed magnetic part being integral with at least one of the supports, the supports each having an abutment area for the mobile magnetic part, the abutment area and the fixed magnetic part being distinct, the mobile magnetic part being in levitation in the gap between both supports by magnetic guiding due to the fixed magnetic part, when the mobile magnetic part is not abutted against the abutment area of one of the supports, wherein the mobile magnetic part is configured to assume plural stable magnetic positions, and in each of the positions the mobile magnetic part is abutted against a support.

2. The magnetic actuator according to claim 1, wherein the mobile magnetic part comprises a magnet.

3. The magnetic actuator according to claim 1, wherein the fixed magnetic part comprises at least one magnetic component part.

4. The magnetic actuator according to claim 3, wherein the magnetic component part comprises a magnet.

5. The magnetic actuator according to claim 3, wherein the magnetic component part comprises thermomagnetic.

6. The magnetic actuator according to claim 1, wherein the fixed magnetic part comprises at least a pair of magnetic component parts on a support.

7. The magnetic actuator according to claim 1, wherein the mobile magnetic part and at least one of the supports include means for centering the mobile magnetic part on the abutment area of the at least one of the supports.

8. The magnetic actuator according to claim 7, wherein the means for centering comprises substantially bevel-shaped relief features, borne both by the at least one of the supports and the mobile magnetic part, the relief features having conjugate shapes.

9. The magnetic actuator according to claim 1, wherein the fixed magnetic part contributes to delimiting at least one of the abutment areas.

10. The magnetic actuator according to claim 1, wherein the means for triggering the displacement of the mobile magnetic part is borne by at least one of the supports.

11. The magnetic actuator according to claim 10, wherein the means for triggering the displacement of the mobile magnetic part has a magnetic effect.

12. The magnetic actuator according to claim 11, wherein the means for triggering the displacement of the mobile magnetic part comprises a heater configured to change magnetic characteristics of the fixed magnetic part.

13. The magnetic actuator according to claim 11, wherein the means for triggering the displacement of the mobile magnetic part creates a magnetic field in a vicinity of the mobile magnetic part.

14. The magnetic actuator according to claim 13, wherein the means for triggering the displacement of the mobile magnetic part comprises at least one conductor, in a vicinity of the mobile magnetic part, the at least one conductor configured to have an electric current flow through it.

15. The magnetic actuator according to claim 14, further comprising means for controlling current to be caused to flow into the at least one conductor, by a position of the mobile magnetic part so that the mobile magnetic part can assume a plurality of stable positions in levitation.

16. The magnetic actuator according to claim 1, wherein the means for triggering the displacement of the mobile magnetic part comprises a pneumatic or hydraulic mechanism.

17. The magnetic actuator according to claim 1, wherein the fixed magnetic part is made in a material selected from the group of soft magnetic materials, hard magnetic materials, materials with hysteresis, superconducting materials, diamagnetic materials, these materials being taken alone or combined.

18. The magnetic actuator according to claim 1, wherein a magnetization of the fixed magnetic part and a magnetization of the mobile magnetic part point in a same direction.

19. The magnetic actuator according to claim 1, wherein at least one abutment area comprises a pair of electrical contacts, and wherein the mobile magnetic part comprises at least one electrical contact, the mobile magnetic part moving to connect both electrical contacts of the pair of contacts when the mobile magnetic part abuts against the abutment area.

20. The magnetic actuator according to claim 1, wherein at least one of the supports comprises a fluid inlet port in the abutment area.

21. The magnetic actuator according to claim 1, wherein the mobile magnetic part comprises a mirror configured to pass through a slot of one of the supports.

22. The magnetic actuator according to claim 1, wherein the supports are made based on semiconducting material, dielectric material, or conducting material, these materials being taken alone or combined.

23. A matrix of magnetic actuators comprising a plurality of magnetic actuators according to claim 1, the magnetic actuators sharing at least one same support.

* * * * *